US012331607B2

(12) United States Patent
Grace et al.

(10) Patent No.: US 12,331,607 B2
(45) Date of Patent: Jun. 17, 2025

(54) DOWNHOLE TOOL INCLUDING RELATED LUG SLOTS AND LUGS FOR COUPLING A MILLING TOOL AND WHIPSTOCK ASSEMBLY

(71) Applicant: Halliburton Energy Services, Inc., Houston, TX (US)

(72) Inventors: Christopher A. Grace, Carrollton, TX (US); Mark Christopher Glaser, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/333,079

(22) Filed: Jun. 12, 2023

(65) Prior Publication Data

US 2024/0410242 A1 Dec. 12, 2024

(51) Int. Cl.
*E21B 29/06* (2006.01)
*E21B 7/08* (2006.01)
*E21B 23/04* (2006.01)

(52) U.S. Cl.
CPC ..... *E21B 23/04* (2013.01); *E21B 29/06* (2013.01)

(58) Field of Classification Search
CPC ..... E21B 29/06; E21B 7/062; E21B 7/064
See application file for complete search history.

(56) References Cited

U.S. PATENT DOCUMENTS 3,116,799 A * 1/1964 Lemons ..... E21B 7/061 166/117.5
3,194,327 A 7/1965 Smithson
5,467,819 A 11/1995 Braddick
5,551,509 A * 9/1996 Braddick ..... E21B 29/06 175/81
6,032,740 A * 3/2000 Schnitker ..... E21B 29/06 175/82
6,105,675 A 8/2000 Buytaert et al.
6,202,761 B1 * 3/2001 Forney ..... E21B 7/067 175/81
6,464,002 B1 10/2002 Hart et al.
10,577,882 B2 * 3/2020 Hulsewe ..... E21B 41/0035
10,724,322 B2 7/2020 Taylor, Jr. et al.
11,053,741 B1 7/2021 Davis et al.
(Continued)

FOREIGN PATENT DOCUMENTS

EP 1272729 A1 1/2003

*Primary Examiner* — Kenneth L Thompson
(74) *Attorney, Agent, or Firm* — Scott Richardson; Parker Justiss, P.C.

(57) ABSTRACT

Provided is a milling tool, a whipstock assembly, a well system, and a method. The milling tool, in at least one aspect, includes a plurality of blades extending radially outward from a mill body, each of the plurality of blades having a primary surface and first and second side surfaces coupled to opposing sides of the primary surface, adjacent blades of the plurality of blades separated by a spacing. The milling tool may further includes a lug slot extending partially into one of the plurality of blades from the first side surface exposed by the spacing, the lug slot configured to engage with a lug of a related tool to couple the milling tool with the related tool when rotating in a first direction and to disengage from the lug of the related tool to release the milling tool from the related tool when rotating in a second opposite direction.

25 Claims, 27 Drawing Sheets

(56) References Cited

U.S. PATENT DOCUMENTS

| | | | | |
|---|---|---|---|---|
| 11,162,315 | B2 * | 11/2021 | Harrington | E21B 29/06 |
| 11,732,539 | B2 * | 8/2023 | Nguyen | E21B 29/06 166/298 |
| 2008/0173481 | A1 | 7/2008 | Menezes et al. | |
| 2012/0261193 | A1 | 10/2012 | Swadi et al. | |
| 2014/0216760 | A1 | 8/2014 | Dancer | |
| 2015/0361764 | A1 | 12/2015 | Cronley | |
| 2016/0237770 | A1 | 8/2016 | Korf | |
| 2020/0087987 | A1 | 3/2020 | Campbell et al. | |
| 2021/0131185 | A1 | 5/2021 | Pray et al. | |
| 2021/0301615 | A1 | 9/2021 | Harrington et al. | |
| 2021/0317705 | A1 | 10/2021 | Gregurek et al. | |
| 2022/0162915 | A1 | 5/2022 | Zhao et al. | |
| 2022/0389771 | A1 | 12/2022 | Niu | |
| 2023/0125650 | A1 | 4/2023 | Nguyen | |
| 2023/0265718 | A1 | 8/2023 | Lajesic | |
| 2023/0265719 | A1 | 8/2023 | Lajesic | |
| 2023/0265743 | A1 | 8/2023 | Lajesic | |

* cited by examiner

DOWNHOLE TOOL INCLUDING RELATED LUG SLOTS AND LUGS FOR COUPLING A MILLING TOOL AND WHIPSTOCK ASSEMBLY

BACKGROUND

The unconventional market is very competitive. The market is trending towards longer horizontal wells to increase reservoir contact. Multilateral wells offer an alternative approach to maximize reservoir contact. Multilateral wells include one or more lateral wellbores (e.g., secondary wellbores) extending from a main wellbore (e.g., primary wellbore). A lateral wellbore is a wellbore that is diverted from the main wellbore or another lateral wellbore.

Lateral wellbores are typically formed by positioning one or more deflector assemblies (e.g., whipstock assemblies) at desired locations in the main wellbore (e.g., an open hole section or cased hole section) with a running tool. The deflector assemblies are often laterally and rotationally fixed within the primary wellbore using an anchoring assembly.

BRIEF DESCRIPTION

Reference is now made to the following descriptions taken in conjunction with the accompanying drawings, in which.

DETAILED DESCRIPTION

Figure 1:
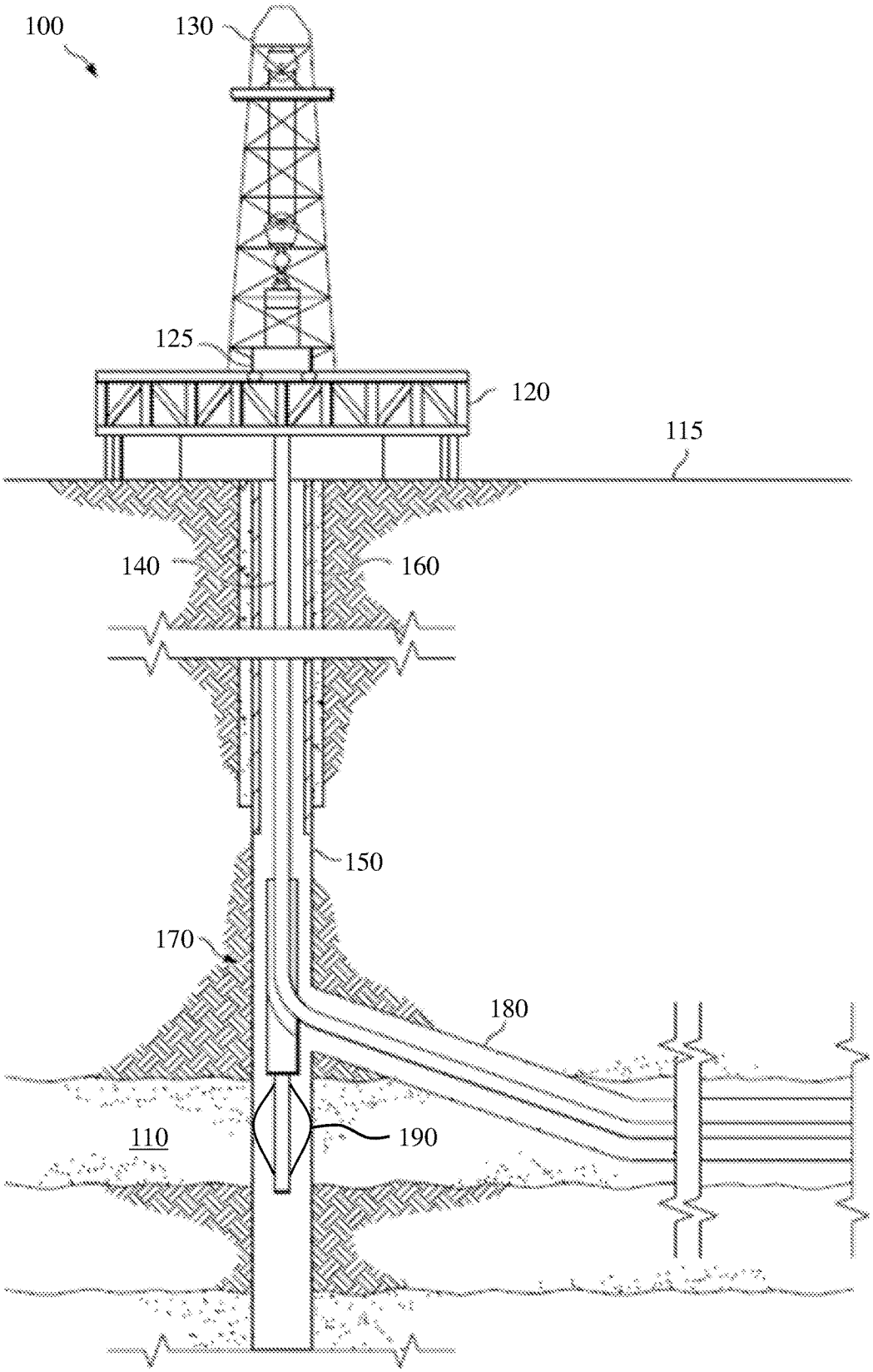
FIG. 1 illustrates a schematic view of a well system designed, manufactured and operated according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water, such as ocean or fresh water.

The disclosure addresses the challenge of running a whipstock assembly on a mill, for example in an effort to reduce trip count. With this in mind, in on embodiment the present disclosure provides a two part drilling and running tool (e.g., including a smaller assembly and a larger bit assembly) that may be used to run a whipstock assembly downhole. In at least one embodiment, the larger bit assembly (e.g., uphole/larger bit assembly) is connected to the whipstock assembly, for example proximate an uphole end of the whipstock assembly. At a desired point in time, the smaller assembly may pull back uphole and connect to the larger bit assembly, thereby forming a new combined bit assembly (e.g., that looks and functions like a conventional lead mill). For purposes of the present disclosure, the term bit assembly is intended to encompass both mill assemblies and drill bit assemblies. Following the successful creation of the exit and the drilling of the lateral, the lateral completion could be installed and then tied together with the main bore by installing a junction (e.g., level 5 junction in one embodiment).

In accordance with at least one embodiment of the disclosure, the smaller assembly is a smaller bit assembly having one or more cutting features (e.g., teeth, blades, etc.) thereon. The smaller assembly, in one embodiment, could be connected to a conveyance that extends through the larger bit assembly and is then connected to the rest of the drill string, or perhaps to a downhole motor directly. In at least one embodiment, the smaller assembly is sized such that it can wholly or partially fit into a bore of the whipstock assembly, such that in one embodiment it may connect to the whipstock assembly or there below. In at least one embodiment, the larger bit assembly and/or smaller assembly are coupled to the whipstock assembly or other downhole device there below using a shear feature, a collection of lugs and/or slots or other connecting mechanism. With the smaller assembly free from the whipstock assembly or other downhole device there below, the smaller assembly is free to slide back uphole and into the larger bit assembly.

Once the smaller assembly has been fully retracted into the larger bit assembly it can be secured to the larger bit assembly for the milling operation. In at least one embodiment, a simple snap ring falls into a groove in the smaller assembly, thereby securing (e.g., laterally securing) the smaller assembly within the larger bit assembly. Many alternate methods are possible, such as spring-loaded pins, a thread, or an interference fit between the two bit assemblies.

At this point the larger bit assembly may be disconnected from the whipstock assembly tip and a normal window can be milled in the casing and/or formation as is current industry practice. As is sometimes the practice with milling windows, secondary mills (e.g., watermelon mills) may be added to follow the lead mill to ensure proper window geometry. Likewise multiple trips may be required to successfully mill a window. In those cases, extra mills or trips could be performed as is done today. Thereafter, the remainder of the multilateral construction may be completed, for example including placing a multilateral junction including a mainbore leg and a lateral bore leg at the junction between the main wellbore and the lateral wellbore.

Up to this point, the use of a two part drilling and running tool has been discussed for creating an exit window from a cased mainbore. An alternate use for this new technology is to sidetrack from an open-hole main bore. In this alternate use, the bit assembly would be more appropriately called a drill bit, as it would be drilling formation to exit the main bore rather milling casing. This would be useful for simple sidetracking where the main bore may need to be abandoned, or it may be used during the construction of an open-hole multilateral junction. In this use, the smaller assembly and larger bit assembly would be designed differently than what is shown herein, for example to closely resemble a drill bit instead of a mill bit. This would necessitate certain changes to the external cutting features, which should be understood to not deviate from the core features described herein.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including one or more conveyance (e.g., pipe strings, such as a drill string 140). Although a land-based oil and gas platform 120 is illustrated in FIG. 1, the scope of this disclosure is not thereby limited, and thus could potentially apply to offshore applications. The teachings of this disclosure may also be applied to other land-based and/or water-based well systems different from that illustrated.

As shown, a main wellbore 150 has been drilled through the various earth strata, including the subterranean formation 110. The term "main" wellbore is used herein to designate a primary wellbore from which another secondary wellbore is drilled. It is to be noted, however, that a main wellbore 150 does not necessarily extend directly to the earth's surface 115, but could instead be a branch of yet another lateral wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

A whipstock assembly 170 according to one or more embodiments of the present disclosure may be positioned at a location in the main wellbore 150. Specifically, the whipstock assembly 170 could be placed at a location in the main wellbore 150 where it is desirable for a lateral wellbore 180 to exit. Accordingly, the whipstock assembly 170 may be used to support a drilling/milling tool used to penetrate a window in the main wellbore 150. In at least one embodiment, once the window has been milled and a lateral wellbore 180 formed, the whipstock assembly 170 may be retrieved and returned uphole by a retrieval tool, in some embodiments in only a single trip.

In some embodiments, an anchoring assembly 190 may be placed downhole in the wellbore 150 to support and anchor downhole tools, such as the whipstock assembly 170, for keeping the whipstock assembly 170 in place while milling the casing 160 and/or drilling the lateral wellbore 180. The anchoring assembly 190, in accordance with the disclosure, may be employed in a cased section of the main wellbore 150, or may be located in an open-hole section of the main wellbore 150, as is shown. As such, the anchoring assembly 190 in at least one embodiment may be configured to resist at least 6,750 newton meters (Nm) (e.g., about 5,000 lb-ft) of torque. In yet another embodiment, the anchoring assembly 190 may be configured to resist at least 13,500 newton meters (Nm) (e.g., about 10,000 lb-ft) of torque, and in yet another embodiment configured to resist at least 20,250 newton meters (Nm) (e.g., about 15,000 lb-ft) of torque. Similarly, the anchoring assembly 190 may be configured to resist at least 1814 kg (e.g., about 4,000 lb) of axial force. In yet another embodiment, the anchoring assembly 190 may be configured to resist at least 4536 kg (e.g., about 10,000 lb) of axial force, and in yet another embodiment the anchoring assembly 190 may be configured to resist at least 6804 kg (e.g., about 15,000 lb) of axial force.

In the illustrated embodiment, the anchoring assembly 190 may be a hydraulically activated anchoring assembly. In this embodiment, once the anchoring assembly 190 reaches a desired location in the main wellbore 150, fluid pressure may be applied to set the hydraulic anchoring assembly. In at least one embodiment, the hydraulically activated anchoring assembly includes two or more hydraulic activation chambers, and the activation fluid is supplied to the two or more hydraulic activation chambers (e.g., through a two-part milling assembly coupled to the whipstock assembly 170) to move the two or more hydraulic activation chambers from the first collapsed state to the second activated state and engage a wall of the main wellbore 150.

The anchoring assembly 190 may also include, in some embodiments, an expandable medium positioned radially about the two or more hydraulic activation chambers. In some aspects, the expandable medium may be configured to grip and engage the wall of the main wellbore 150 when the two or more hydraulic activation chambers are in the second activated state. Notwithstanding, other fluid activated anchoring assemblies (e.g., other than those having two or more hydraulic activation chambers) may be used and remain within the scope of the disclosure. In at least one other embodiment, the hydraulically activated anchoring assembly includes one or more hydraulic activation slips, and the activation fluid is supplied to the one or more hydraulic activation slips (e.g., through a two-part milling assembly coupled to the whipstock assembly 170) to move the one or more hydraulic activation slips from the first collapsed state to the second activated state and engage the wall of the main wellbore 150.

Furthermore, mechanical activated anchoring assemblies could also be used and remain within the scope of the disclosure. For instance, in yet other embodiments, the anchoring assembly 190 is a latch coupling. In this embodiment, the latch coupling (e.g., a profile in the casing engages with a reciprocal profile in the whipstock assembly 170) anchors the whipstock assembly 170, and any other features hanging there below (e.g., screens, valves, etc.) in the casing string 160. Once the anchoring assembly 190 reaches a desired location in the main wellbore 150, the reciprocal profile in the whipstock assembly 170 may be activated to engage with the latch coupling profile in the casing string 160, thereby setting the anchoring assembly 190. Thus, in at least one embodiment, the anchoring assembly 190 is not hydraulically activated, but is mechanically activated.

In at least one embodiment, a multilateral junction is positioned at an intersection between the resulting main wellbore 150 and the resulting lateral wellbore 180. In accordance with one embodiment, the multilateral junction might include a main bore leg forming a first pressure tight seal with the main bore completion and a lateral bore leg forming a second pressure tight seal with the lateral bore completion, such that the main bore completion and the lateral bore completion are hydraulically isolated from one another. What results, in one or more embodiments, is an open hole TAML Level 5 pressure tight junction.

Figure 2A:
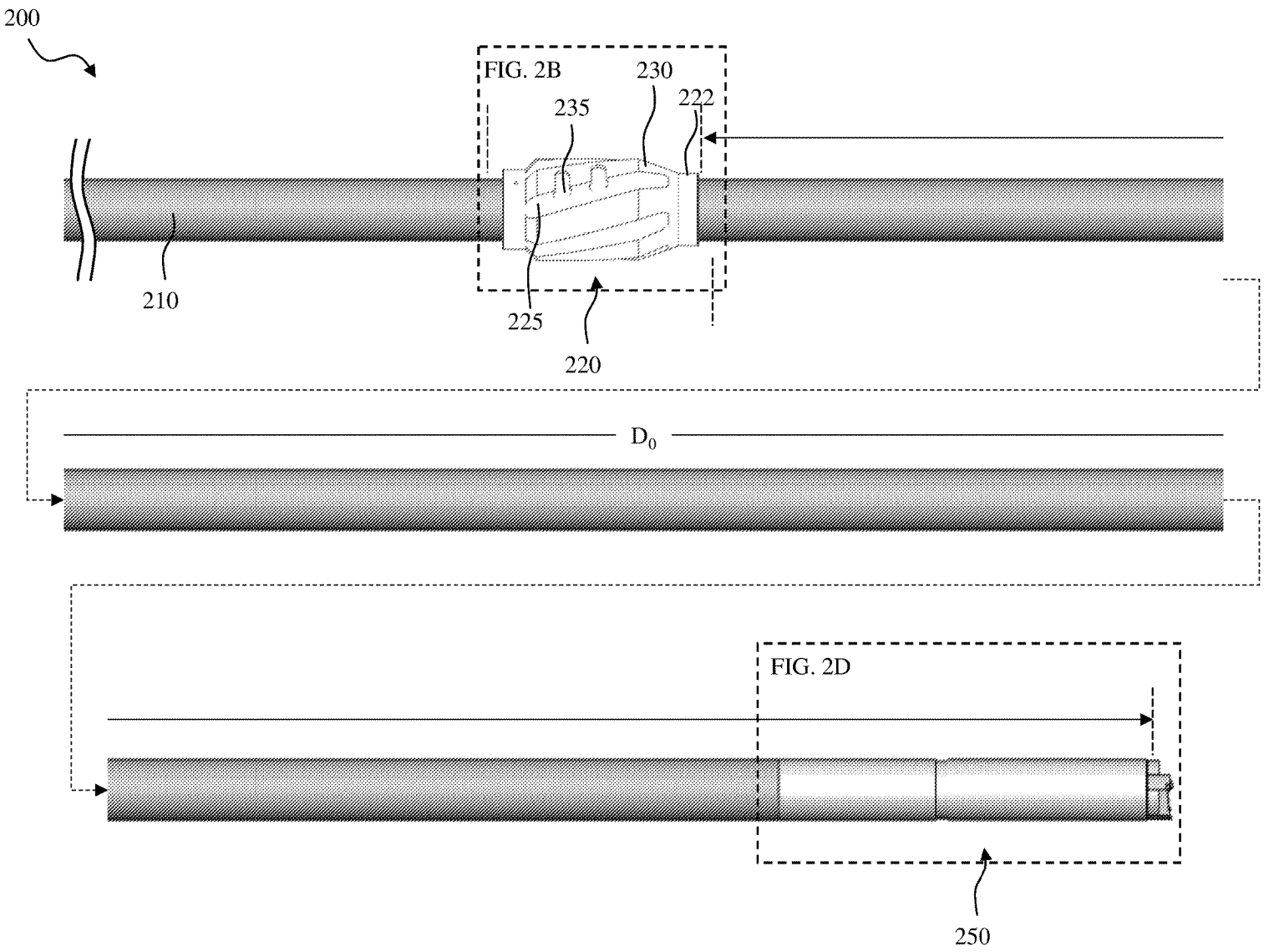
FIGS. 2A through 2E illustrate various different views of a two part milling and running tool designed, manufactured and operated according to one or more embodiments of the disclosure.
Figure 2B:
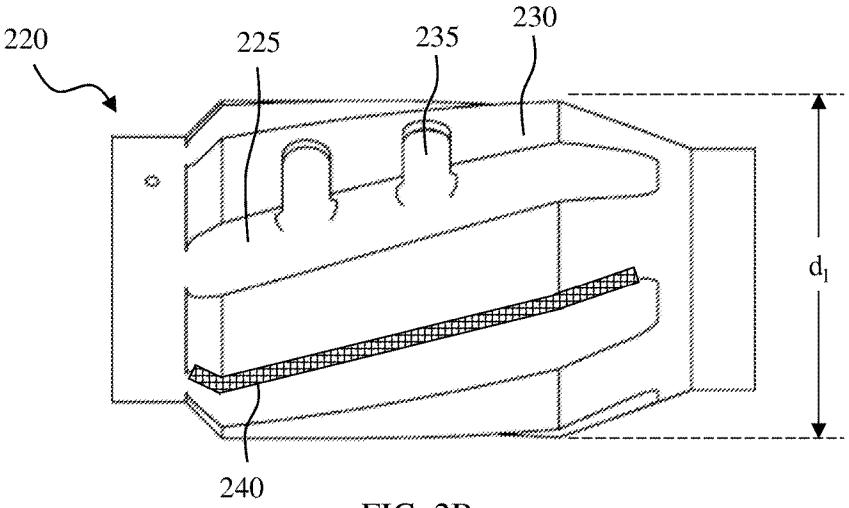
Figure 2C:
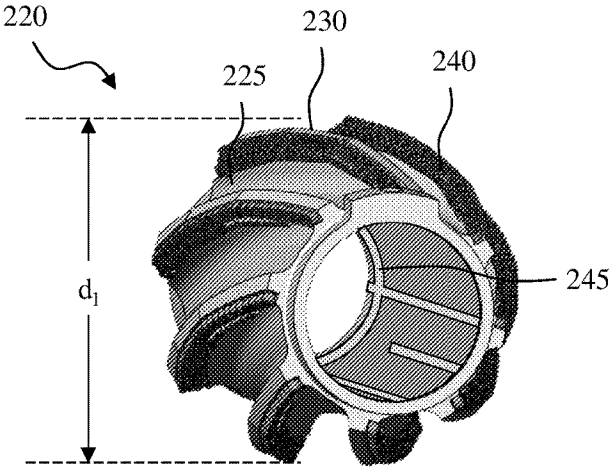
Figure 2D:
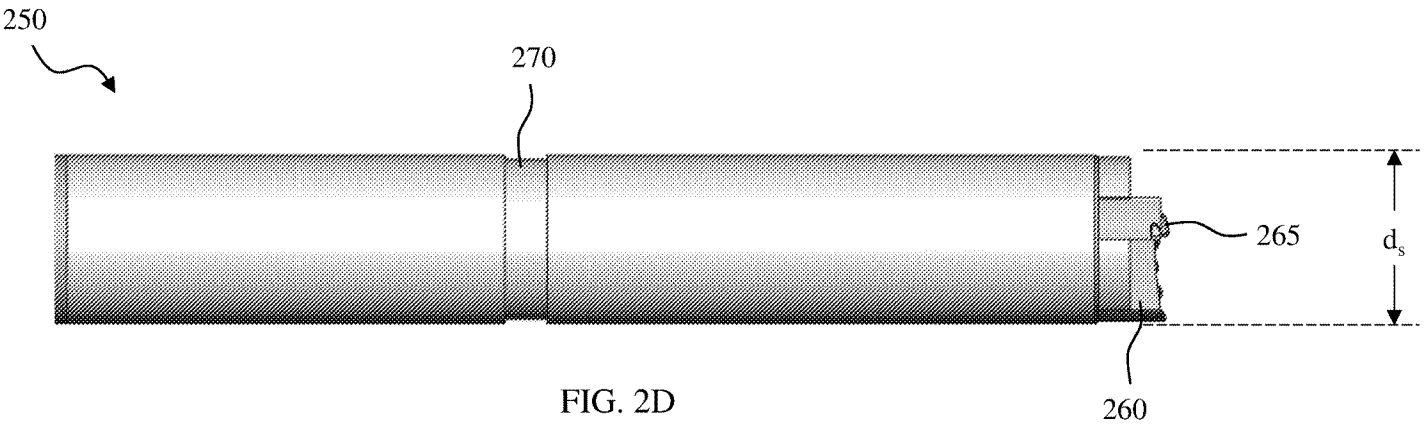
Figure 2E:
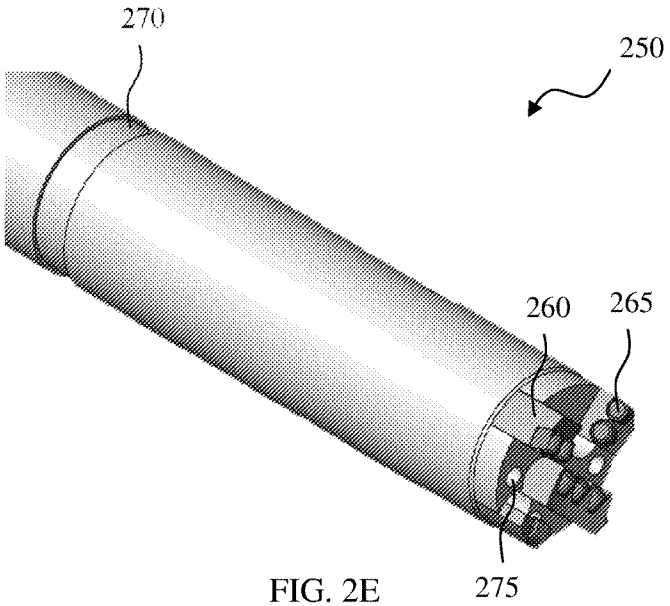

Turning now to FIGS. 2A through 2E, illustrated are various different views of a two part milling and running tool 200 designed, manufactured and operated according to one or more embodiments of the disclosure. FIG. 2A illustrates a side view of the two part milling and running tool 200. FIG. 2B illustrates an enlarged side view of a larger bit assembly of FIG. 2A. FIG. 2C illustrates an isometric view of one embodiment of an internal profile of the larger bit assembly of FIG. 2A. FIG. 2D illustrates an enlarged side view of a smaller assembly of FIG. 2A. FIG. 2E illustrates an isometric view of one embodiment of the smaller assembly of FIG. 2A.

With initial reference to FIG. 2A, the two part milling and running tool 200, in the illustrated embodiment, includes a conveyance 210. The conveyance 210, in at least one embodiment, is a tubular, such as jointed pipe or coiled tubing. The two part milling and running tool 200, as shown in the embodiment of FIGS. 2A through 2E, may additionally include a larger bit assembly 220 and a smaller assembly 250 coupled thereto. As indicated above, the phrase "bit assembly," as used herein, is intended to include both milling assemblies (e.g., as might be used to mill through casing) and drill bit assemblies (e.g., as might be used to drill through formation), as well as any combination of the two. As discussed above, and shown in the FIGS., the smaller assembly 250 may also be a smaller bit assembly, and thus may contain one or more different types of cutting features along a downhole face thereof.

In the illustrated embodiment of FIGS. 2A through 2E, the smaller assembly 250 is coupled to an end (e.g., coupled proximate, such as within 2 meters, if not within 1 meter, if not within 0.5 meters, if not within 0.1 meters, a downhole end) of the conveyance 210, whereas the larger bit assembly 220 is in sliding engagement with the conveyance 210. Accordingly, assuming that something (e.g., friction, a shear feature, etc.) is holding the larger bit assembly 220 in place as the conveyance 210 is moved, the smaller assembly 250 may slide relative to the larger bit assembly 220. For instance, if the conveyance 210 were withdrawn uphole, the larger bit assembly 220 would slide along the conveyance 210, thereby allowing the smaller assembly 250 to slide toward the larger bit assembly 220.

As will be discussed in greater detail below, the two part milling and running tool 200 may be used to deploy a whipstock assembly, and thus may be coupled to the whipstock assembly when running downhole. In at least one embodiment, the larger bit assembly 220 is coupled to the whipstock assembly, for example using a collection of lug slot(s) and lug(s). The smaller assembly 250 may also be coupled to one of the whipstock assembly, the anchoring assembly or the wellbore liner, in at least one embodiment, which would prevent the smaller assembly 250 from sliding toward the larger bit assembly 220 during the run-in-hole phase. Only when the smaller assembly 250 is decoupled from the whipstock assembly, the anchoring assembly or the wellbore liner, would the smaller assembly 250 be allowed to slide toward the larger bit assembly 220 (e.g., assuming that the larger bit assembly 220 is still coupled to the whipstock assembly or held in place with friction).

In the illustrated embodiment of FIG. 2A, the two part milling and running tool 200 is positioned in the run-in-hole position. In this run-in-hole position, the larger bit assembly 220 would be spaced apart from the smaller assembly 250 by a distance ($D_0$). In at least one embodiment, the distance ($D_0$) approximates the length of the whipstock assembly that the two part milling and running tool 200 is coupled to. According to this embodiment, the smaller assembly 250 might couple proximate a downhole end of the whipstock assembly, whereas the larger bit assembly 220 might couple proximate an uphole end of the whipstock assembly. Thus, in at least one embodiment, the distance ($D_0$) is at least 1 meter, or at least 2 meters. In yet another embodiment, the distance ($D_0$) is at least 4 meters, and in even another embodiment the distance ($D_0$) is at least 5 meters. In at least one other embodiment, the distance ($D_0$) approximates the length of the whipstock assembly and at least a portion of the length of the anchoring assembly. In at least yet another embodiment, the distance ($D_0$) approximates the length of the whipstock assembly, the length of the anchoring assembly, and at least a portion of the length of a wellbore liner.

In at least one embodiment, as discussed in greater detail below, the larger bit assembly 220 includes a mill body 222 having a plurality of blades 230 extending radially outward therefrom (e.g., whether extending directly radially outward therefrom or extending indirectly radially outward therefrom), each of the plurality of blades 230 having a primary surface and first and second side surfaces coupled to opposing sides of the primary surface. In at least one embodiment, adjacent blades of the plurality of blades are separated by a spacing 225. Further to this embodiment, the larger bit assembly 220 may include a lug slot 235 extending partially into one of the plurality of blades 230 from the first side surface exposed by the spacing 225. In one or more embodiments, the lug slot 235 is configured to engage with a lug (not shown) of a related tool (e.g., whipstock assembly) to couple the two part milling and running tool 200 with the related tool when rotating in a first direction, and to disengage from the lug (not shown) of the related tool to release the two part milling and running tool 200 from the related tool when rotating in a second opposite direction.

Turning now to FIG. 2B, the larger bit assembly 220 may have one or more cutting features 240 on the one or more blades 230. While specific blades 230 and cutting features 240 are illustrated in FIG. 2B, any currently known or hereafter discovered blades and cutting features may be used and remain within the scope of the disclosure. The larger bit assembly 220, in the illustrated embodiment, includes a cutting diameter (di). In at least one embodiment, the cutting diameter (di) approximates the size of an opening (e.g., in the casing and/or formation) forming a lateral wellbore.

Turning now to FIG. 2C, in at least one embodiment, the larger bit assembly 220 may also include a lock ring profile 245, which may be configured to hold a lock ring (not shown) that could ultimately engage with an associated lock ring profile in the smaller assembly 250, or vice versa.

Turning now to FIG. 2D, the smaller assembly 250 may have one or more blades 260 and one or more cutting features 265 thereon, thereby making the smaller assembly 250 a smaller bit assembly. While specific blades 260 and cutting features 265 are illustrated in FIG. 2D, any currently known or hereafter discovered blades and cutting features may be used and remain within the scope of the disclosure. The smaller assembly 250, in the illustrated embodiment, includes a cutting diameter ($d_s$). In at least one embodiment, the cutting diameter ($d_s$) is at least 10 percent less than the cutting diameter ($d_l$). In at least one embodiment, the cutting diameter ($d_s$) is at least 25 percent less than the cutting diameter ($d_l$), in yet another embodiment at least 50 percent less than the cutting diameter ($d_l$), in yet another embodiment at least 75 percent less than the cutting diameter ($d_l$), and in yet another embodiment at least 90 percent less than the cutting diameter ($d_l$). The smaller assembly 250, in the illustrated embodiment, may further include an associated lock ring profile 270. Accordingly, the lock ring profile 270, as well as the associated lock ring profile 245 of the larger bit assembly 220, and a lock ring (not shown), may be used to linearly fix the larger bit assembly 220 and the smaller assembly 250.

Turning now to FIG. 2E, the smaller assembly 250 may additionally include one or more fluid ports 275. The one or more fluid ports 275, in the illustrated embodiment, may provide fluid access past the smaller assembly 250, to help cool the bit/mill, lubricate and remove cuttings. In yet another embodiment, the one or more fluid ports 275, provide fluid access past the smaller assembly 250, particularly, when the smaller assembly 250 is coupled to and sealed with the whipstock assembly. For example, the one or more fluid ports 275 may be fluidly coupled with a through bore in the whipstock assembly, and thus may be used to activate a hydraulic wellbore anchoring assembly, among other downhole features.

Figure 3A:
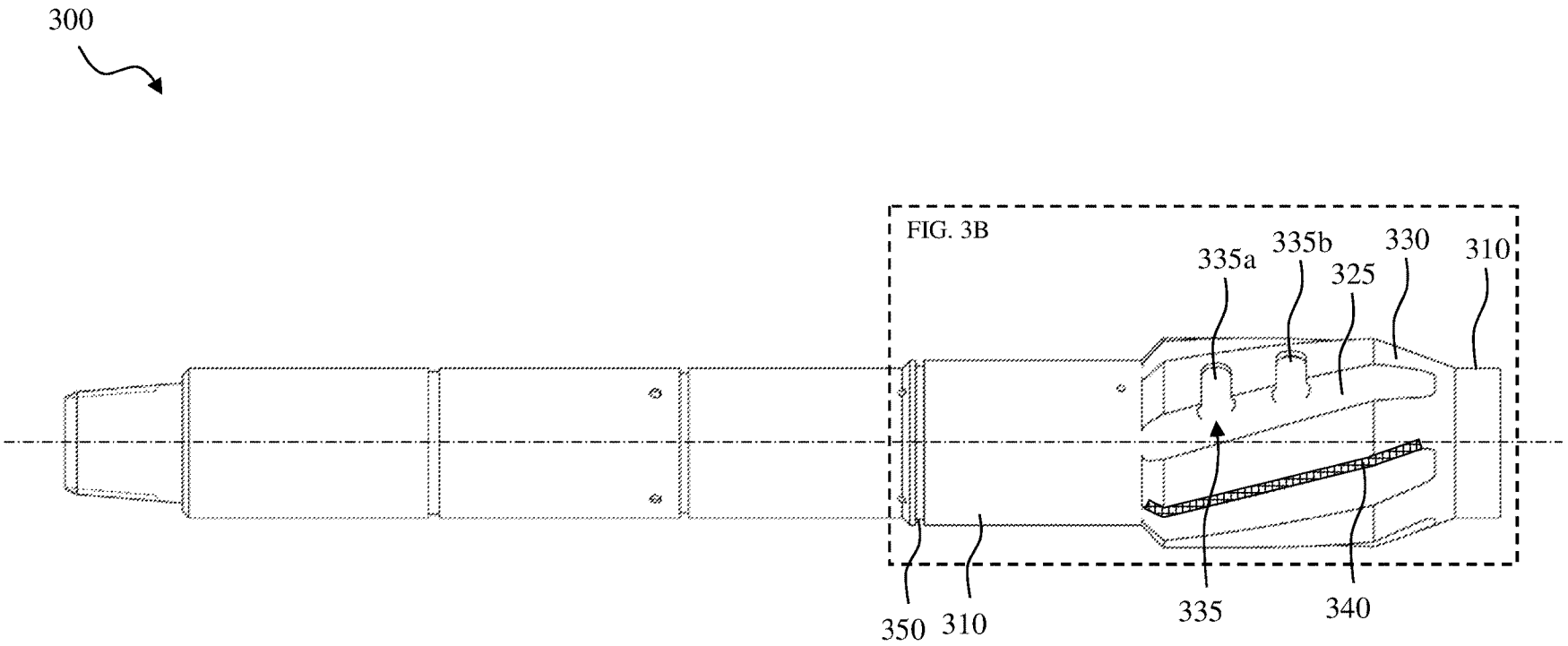
FIGS. 3A and 3B illustrate various different views of a milling tool designed, manufactured and/or operated according to one or more embodiments of the disclosure.
Figure 3B:
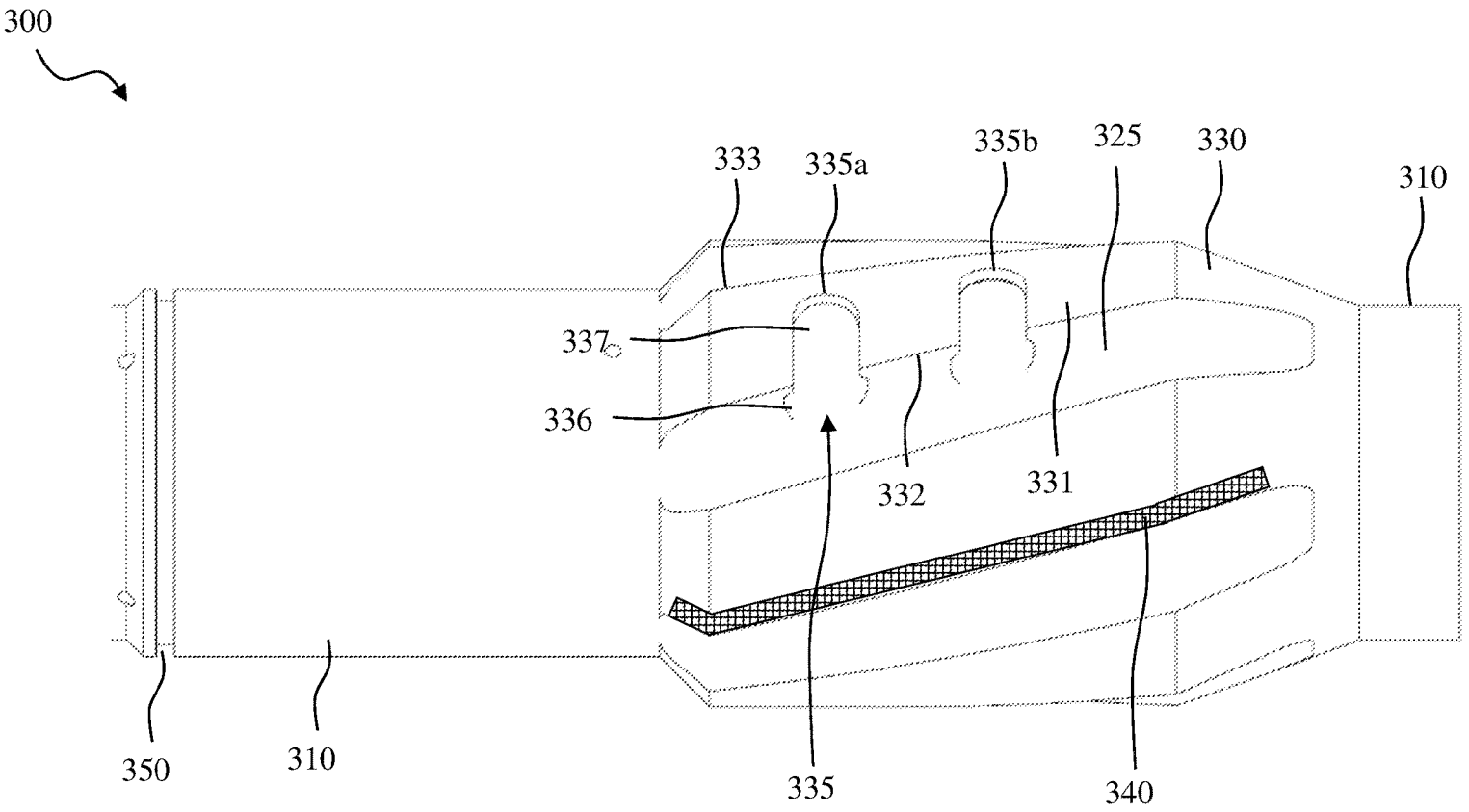

Turning to FIGS. 3A and 3B, illustrated are various different views of a milling tool 300 designed, manufactured and/or operated according to one or more embodiments of the disclosure. The milling tool 300, in the illustrated embodiment, includes a mill body 310. In at least one embodiment, the mill body 310 is a tubular. The milling tool 300, in one or more embodiments, may additionally include a plurality of blades 330 extending radially outward therefrom, each of the plurality of blades 330 having a primary surface 331 and first and second side surfaces 332, 333 coupled to opposing sides of the primary surface 331. In the illustrated embodiment, adjacent blades of the plurality of blades 330 are separated by a spacing 325.

Further to the embodiment of FIGS. 3A and 3B, the milling tool 300 may additionally include a lug slot 335 extending partially into one of the plurality of blades 330 from the first side surface 332 exposed by the spacing 325. In accordance with this embodiment, the lug slot 335 is configured to engage with a lug (not shown) of a related tool (e.g., whipstock assembly) to couple the milling tool 300 with the related tool. For example, the lug slot 335 may engage the milling tool 300 with the related tool when rotating in a first direction, and disengage from the lug of the related tool to release the milling tool from the related tool when rotating in a second opposite direction. In the illustrated embodiment, the lug slot 335 has a larger lug slot portion 336 radially proximate the mill body 310 and a smaller lug slot portion 337 radially distal the mill body 310. For example, in one or more embodiments, the lug slot 335 is an inverted T-shaped lug slot, as shown.

Further to the embodiment of FIGS. 3A and 3B, the lug slot 335 is a first lug slot 335*a*, and the milling tool 300 further includes a second lug slot 335*b* extending partially into one of the plurality of blades 330 from a first side surface 332 exposed by a spacing 325. In the illustrated embodiment, the first lug slot 335*a* and the second lug slot 335*b* are located in a same one of the plurality of blades 330. In another embodiment, the first lug slot 335*a* is located in a first of the plurality of blades 330 and the second lug slot 335*b* is located in a second of the plurality of blades 330. While only first and second lug slots 335*a*, 335*b* are illustrated in the embodiment of FIGS. 3A and 3B, other embodiments exists wherein more than two lug slots 335 are located in a single one of the plurality of blades 330, or more than two lug slots 335 are located in two or more of the plurality of blades 330.

In at least one embodiment, the lug slot(s) 335 are oriented such that any axial loading (e.g., uphole and downhole axial loading) will communicate between the mill body 310 (e.g., high strength steel mill body) and the lug in the related device (e.g., lug in the whipstock assembly). In at least one embodiment, the lug slot(s) 335 are also oriented so that right hand rotational communication through the conveyance (e.g., drill string) will communicate rotational loading between the mill body 310 and the lug in the related device (e.g., lug in the whipstock assembly). Similarly, left hand rotation will communicate rotational loading between the lug in the related device (e.g., lug in the whipstock assembly) and a finger portion in a related shifting sleeve, which is acceptable since there is generally no need to communicate high levels of left hand torque.

In the illustrated embodiment of FIGS. 3A and 3B, the milling tool 300 may have one or more cutting features 340 on the one or more blades 330. While specific blades 330 and cutting features 340 are illustrated in FIGS. 3A and 3B, any currently known or hereafter discovered blades and cutting features may be used and remain within the scope of the disclosure. Further to the embodiment of FIGS. 3A and 3B, the milling tool 300 may have a seal groove 350 (e.g., as might include a seal member) therein.

Figure 4A:
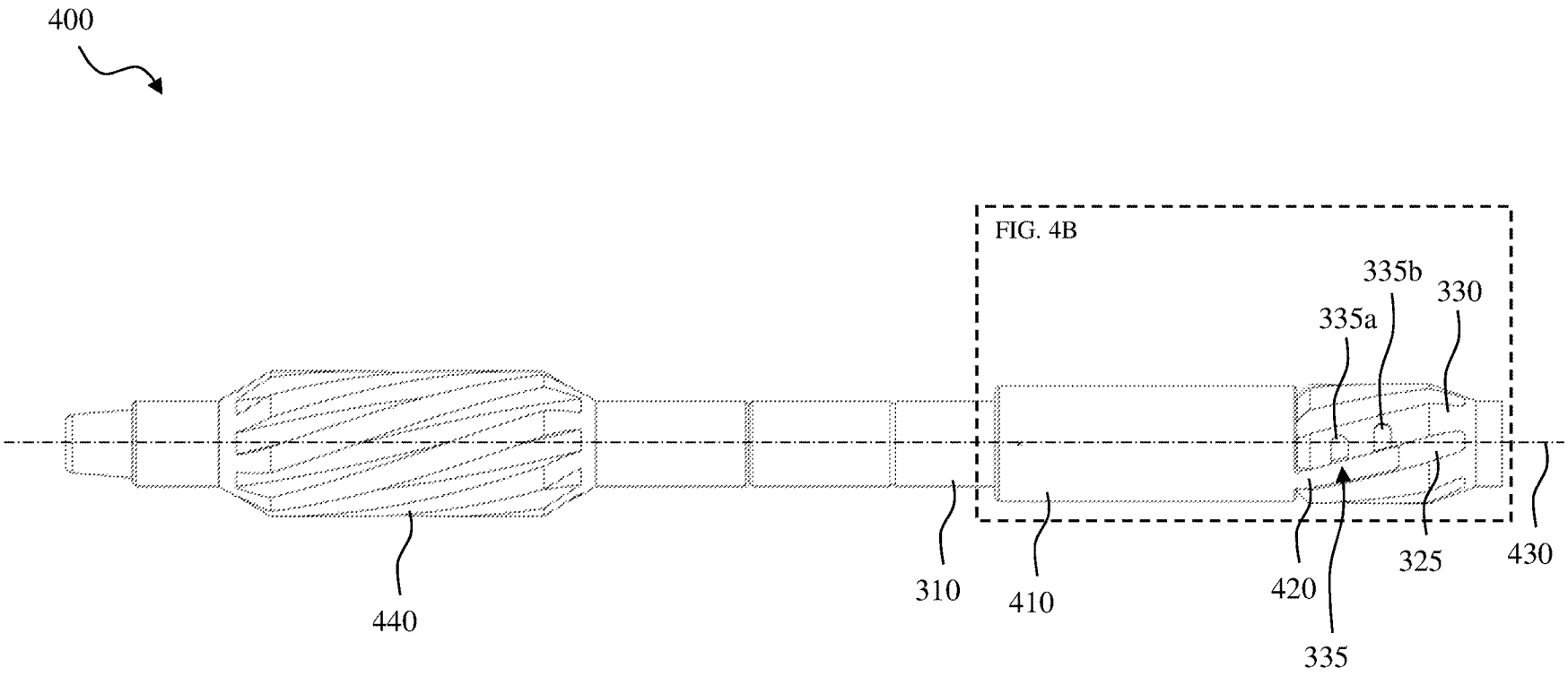
FIGS. 4A and 4B illustrate various different views of a milling tool designed, manufactured and/or operated according to one or more alternative embodiments of the disclosure.
Figure 4B:
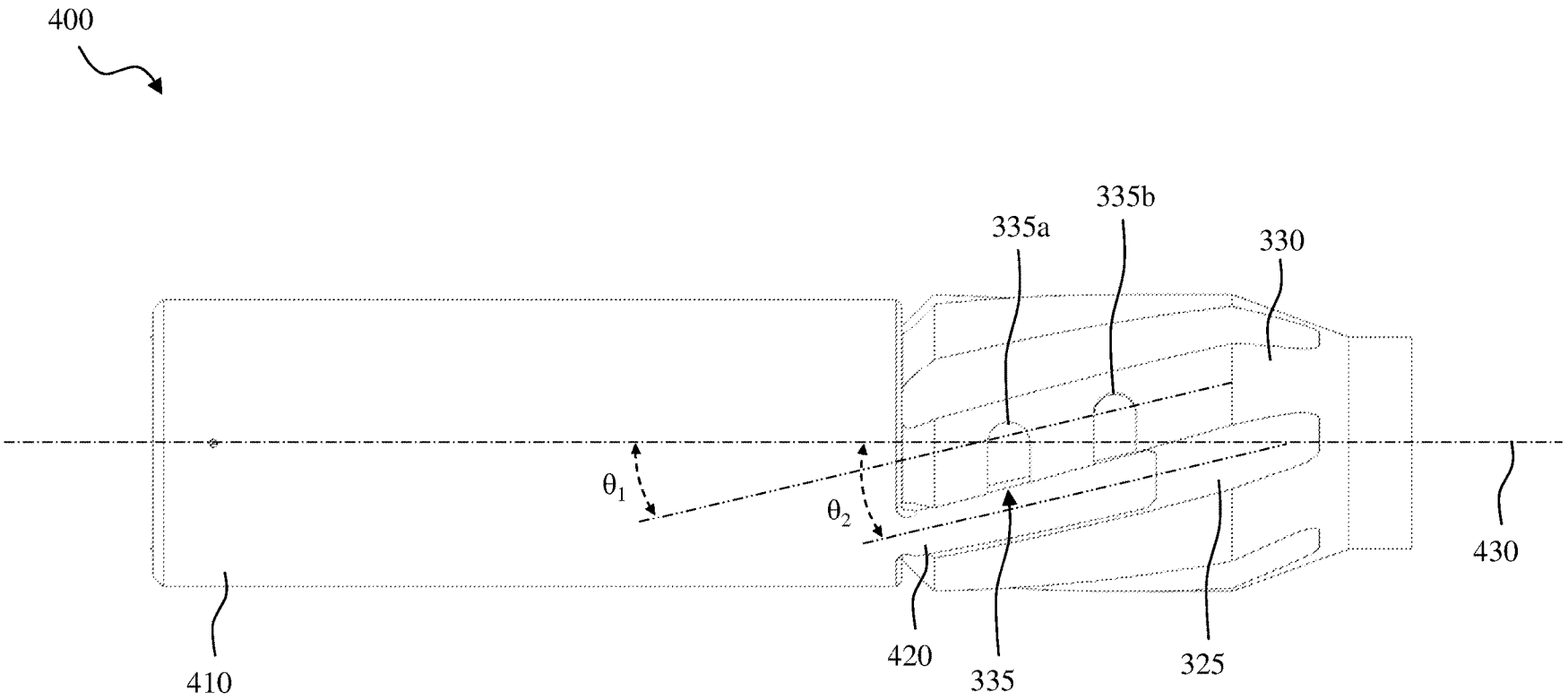

Turning to FIGS. 4A and 4B, illustrated are various different views of a milling tool 400 designed, manufactured and/or operated according to one or more alternative embodiments of the disclosure. The milling tool 400 of FIGS. 4A and 4B is similar in many respects to the milling tool 300 of FIGS. 3A and 3B. Accordingly, like reference numbers have been used to indicate similar, if not identical, features. The milling tool 400 differs, for the most part, from the milling tool 300, in that the milling tool 400 additionally includes a sliding sleeve 410 positioned about the mill body 310 proximate the plurality of blades 330. In at least one embodiment, the sliding sleeve 410 includes a finger portion 420, the sliding sleeve 410 configured to move between a first position (e.g., that shown in FIGS. 4A and 4B) locating the finger portion 420 within the spacing 325 proximate the lug slot 335, and a second position (e.g., not shown) removing the finger portion 420 from the spacing 325 proximate the lug slot 335. In at least one embodiment, the first position is configured to keep the lug of the related tool engaged within the lug slot 335, and the second position is configured to allow the lug of the related tool to disengage from the lug slot 335.

In one or more embodiments, the plurality of blades 330 are angled relative to an axis of rotation 430 of the mill body 310, and furthermore the finger portion 420 is angled relative to the axis of rotation 430 of the mill body 310. Accordingly, in at least one embodiment, a first angle ($\theta_1$) of the plurality of blades 330 is substantially identical to a second angle ($\theta_2$) of the finger portion 420. The term "substantially identical," as used herein with respect to these angles, means that the angles are within 15 percent of each other. In yet another embodiment, the first angle ($\theta_1$) of the plurality of blades 330 is ideally identical to the second angle ($\theta_2$) of the finger portion 420, wherein "ideally identical" means that the angles are within 10 percent of each other. In yet even another embodiment, the first angle ($\theta_1$) of the plurality of blades 330 is exactly identical to the second angle ($\theta_2$) of the finger portion 420, wherein "exactly identical" means that the angles are within 5 percent of each other. In yet another embodiment, the first angle ($\theta_1$) of the plurality of blades 330 is perfectly identical to the second angle ($\theta_2$) of the finger portion 420, wherein "perfectly identical" means that the angles are within 2 percent of each other. In another embodiment, the first angle ($\theta_1$) and the second angle ($\theta_2$) are the same. In yet another embodiment, the plurality of blades 330 are curved and the finger portion 420 is curved, for example using the same similarities (e.g., identical values) as to when they are angled.

As will be further understood below, the sliding sleeve 410 may be a hydraulically activated sliding sleeve, an increase in pressure within the mill body 310 configured to move the sliding sleeve from the first position to the second position. In yet another embodiment, the sliding sleeve 410 is a mechanically activated sliding sleeve, an external mechanical movement configured to move the sliding sleeve 410 from the first position to the second position. In an effort to keep the sliding sleeve 410 in the first position while running downhole, a shear feature (e.g., shear pin, shear screw, etc.) may exist between the sliding sleeve 410 and the mill body 310.

The milling tool 400, in one or more other embodiments, may include a secondary mill 440. For example, in one or more embodiments, the milling tool 400 could include a watermelon mill as the secondary mill 440. Those skilled in the art understand the benefits of including the secondary mill 440 with the milling tool 400.

Figure 5A:
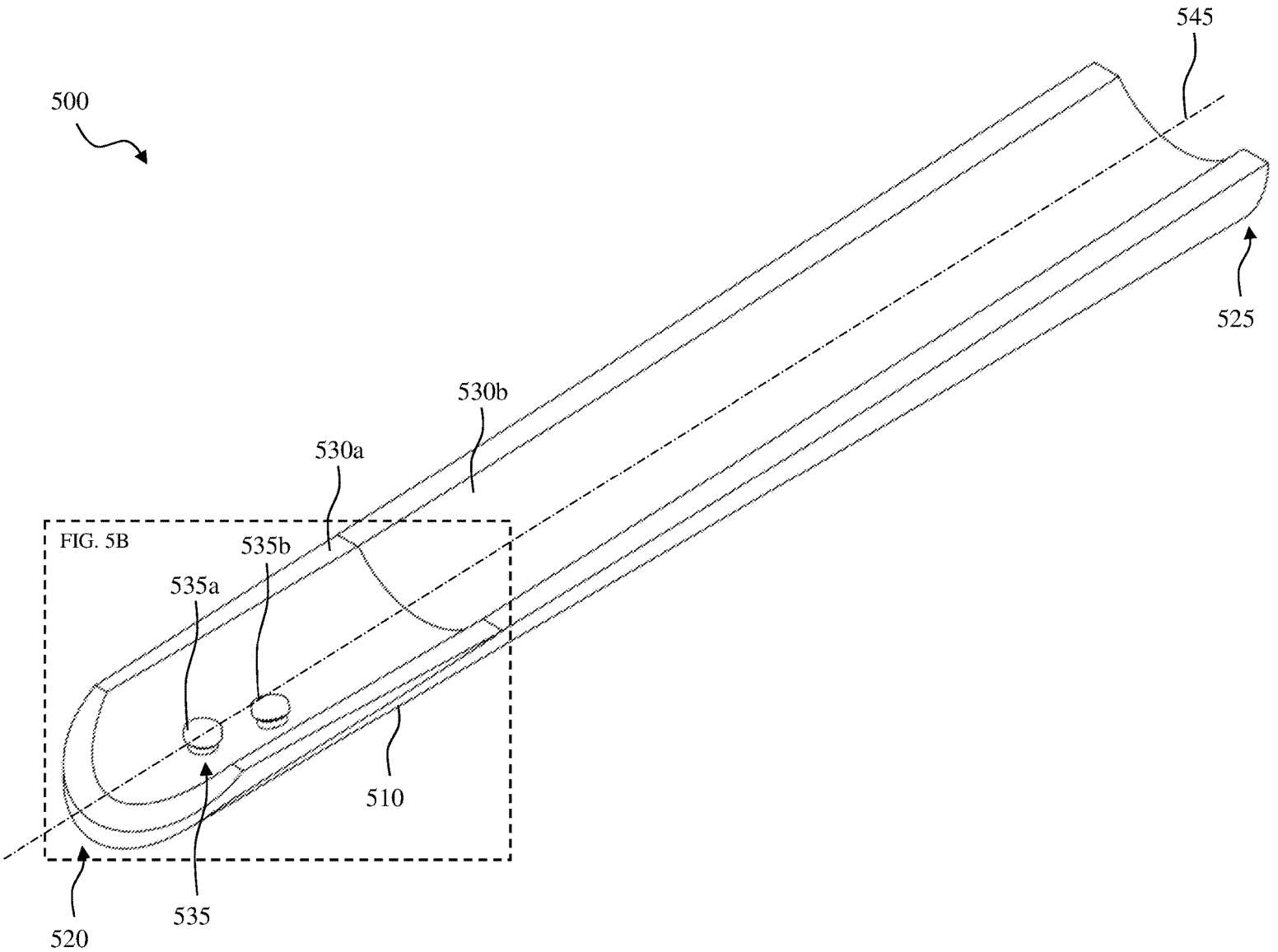
FIGS. 5A and 5B illustrate various different views of a whipstock assembly designed, manufactured and/or operated according to one or more embodiments of the disclosure.
Figure 5B:
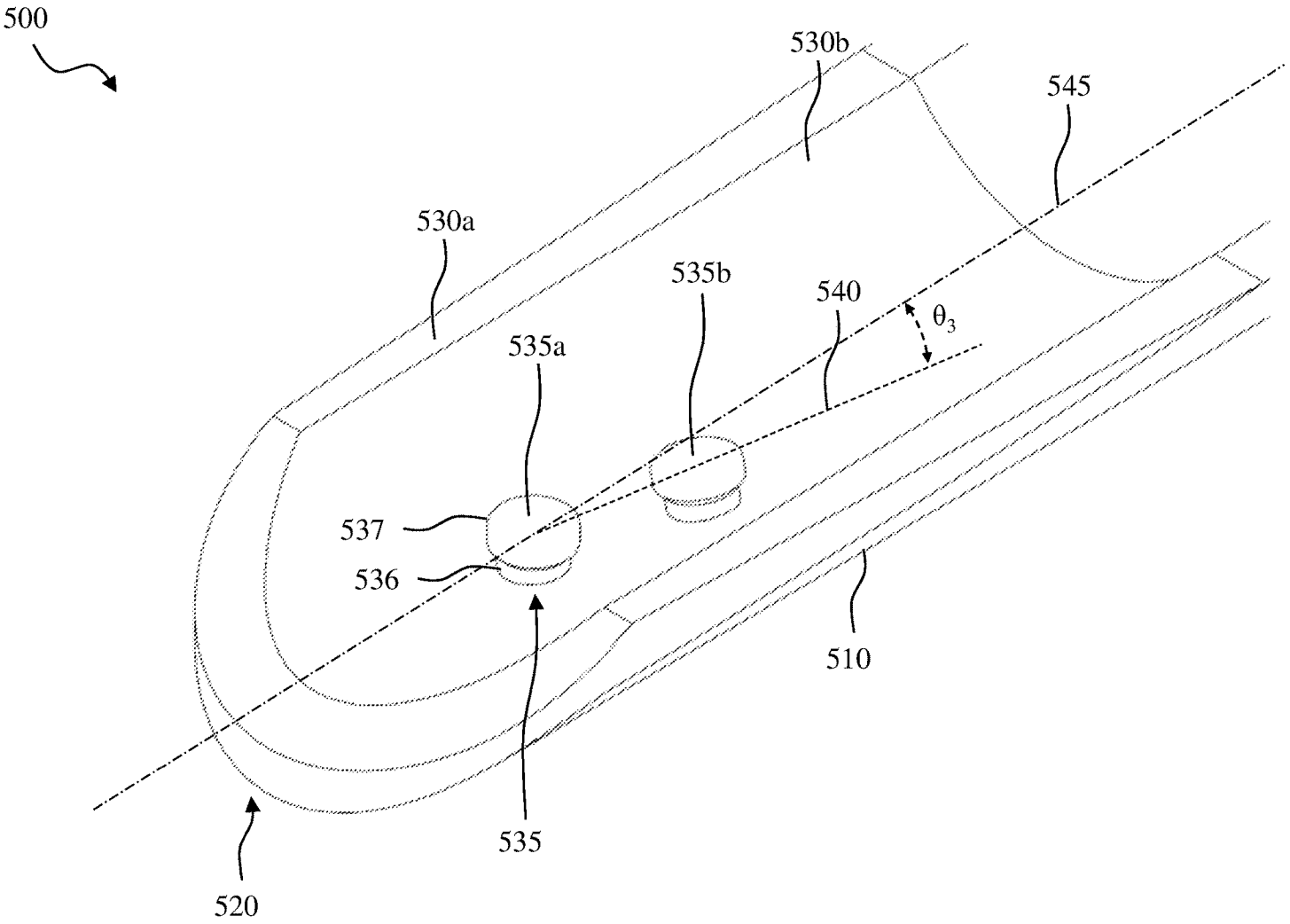

Turning now to FIGS. 5A and 5B, illustrated is one embodiment of a whipstock assembly 500 designed, manufactured and/or operated according to one or more embodiments of the disclosure. The whipstock assembly 500, in one embodiment, includes a whipstock body 510. The whipstock body 510, in at least one embodiment, has an uphole end 520 and a downhole end 525. Further to the embodiment of FIGS. 5A and 5B, the whipstock body 510 may define a taperface 530*a* and may have a concave portion 530*b*.

In accordance with one embodiment of the disclosure, the whipstock assembly 500 may additionally include a lug 535 coupled proximate the uphole end 520 of the whipstock body 510. The term "proximate," as used with respect to the lug 535, means within an uphole 30 percent of the whipstock body. In yet another embodiment, the lug 535 is coupled substantially proximate the uphole end 520 of the whipstock body 510, wherein the term "substantially proximate" means within an uphole 20 percent of the whipstock body. In yet another embodiment, the lug 535 is coupled ideally proximate the uphole end 520 of the whipstock body 510, wherein the term "ideally proximate" means within an uphole 10 percent of the whipstock body.

In at least one embodiment, the lug 535 may be coupled to the concave portion 530*b* of the whipstock body 510. In accordance with one embodiment, the lug 535 is configured to engage with a lug slot (e.g., not shown, but in one embodiment the lug slot 335 of FIGS. 3A through 4B) of a related milling tool (e.g., not shown, but in one embodiment the milling tool 300, 400 of FIGS. 3A through 4B) to couple the whipstock assembly 500 with the related milling tool. For example, the lug 535 may engage with the related lug slot when the milling tool rotates in a first direction, and to disengage from the related lug slot of the related milling tool to release the whipstock assembly 500 from the related milling tool when the milling tool rotates in a second opposite direction.

In one or more embodiments, such as that shown, the lug 535 has a smaller lug portion 536 and a larger lug portion 537. Further to this embodiment, the smaller lug portion 536 may be more proximate the whipstock body 510 than the larger lug portion 537. In accordance with one or more embodiments, the lug 535 is a T-shaped lug, the smaller lug portion 536 coupled to the whipstock body 510. In at least one other embodiment, a first footprint of a portion of the lug 535 proximate the whipstock body 510 is different than a second footprint of a portion of the lug 535 distal the whipstock body 510. For example, in one or more embodiments the first footprint is smaller than the second footprint.

In the illustrated embodiment, the lug 535 is a first lug 535*a*, and the whipstock assembly 500 further includes a second lug 535*b* coupled proximate the uphole end 520 of the whipstock body 510. In at least one embodiment, a centerline 540 taken through the first lug 535*a* and the second lug 535*b* is angled relative to a longitudinal centerline 545 of the whipstock body 510. In yet another embodiment, an angle (03) between the centerline 540 and the longitudinal centerline 545 is substantially identical to an angle (01) of a plurality of blades of the related milling tool that the whipstock assembly is configured to engage (e.g., angle (01) of FIG. 4B).

The lug 535 may be formed in a number of different methods. In at least one embodiment, the lug 535 is integrally formed with the whipstock body 510. In yet another embodiment, the lug 535 is coupled to the whipstock body 510 via an opening (not shown) in the whipstock body 510. In yet another embodiment, a fastener (not shown) extends at least partially into the opening to couple the lug 535 to the whipstock body 510. In even another embodiment, the log 535 is welded to the whipstock body 510.

With reference to FIGS. 3A through 5B, the present disclosure creates a high strength connection between a milling tool 300, 400 and a whipstock assembly 500. Traditionally, this connection is a shear feature with maximum axial rating of less than 100 kip, and maximum torque rating of less than 25,000 ft-lb. This new high strength connection, however, can achieve axial loads much greater than achievable with the current shear feature, since (e.g., among other reasons) the number, size and/or shape of the whipstock lugs can vary. Furthermore, the lug slots of the present disclosure may capture the lug of the present disclosure on all but one side.

Turning to FIGS. 6 through 13C, illustrated is one embodiment for designing, manufacturing and/or operating a downhole tool 600 according to the present disclosure. The downhole tool 600 of FIGS. 6 through 13C includes many of the same feature as the milling tool 400 of FIGS. 4A and 4B and whipstock assembly 500 of FIGS. 5A and 5B. Accordingly, like reference numbers have been used to indicate similar, if not identical, features.

Figure 6:
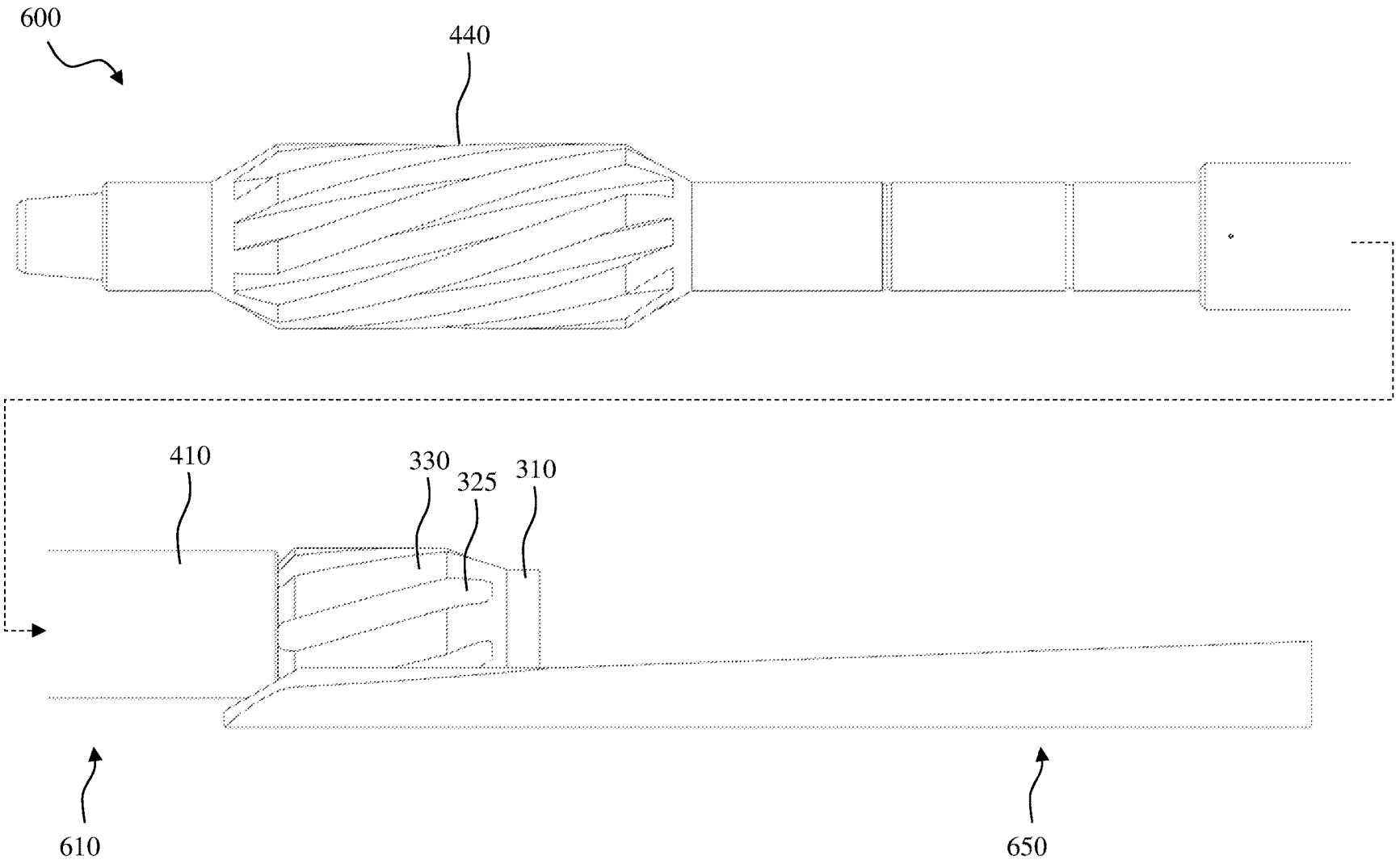
FIGS. 6 through 13C illustrate one embodiment for designing, manufacturing and/or operating a downhole tool 600 according to the present disclosure.

Turning to FIG. 6, illustrated is a side view of the downhole tool 600 according to one embodiment of the disclosure. The downhole tool 600, in this view, includes a milling tool 610 coupled with a whipstock assembly 650.

For example, FIG. 6 illustrates the downhole tool 600 as it might appear during it's run-in-hole configuration, wherein the milling tool 610 is similar in many respects to the milling tool 400 and the whipstock assembly 650 is similar in many respects to the whipstock assembly 500.

Figure 7A:
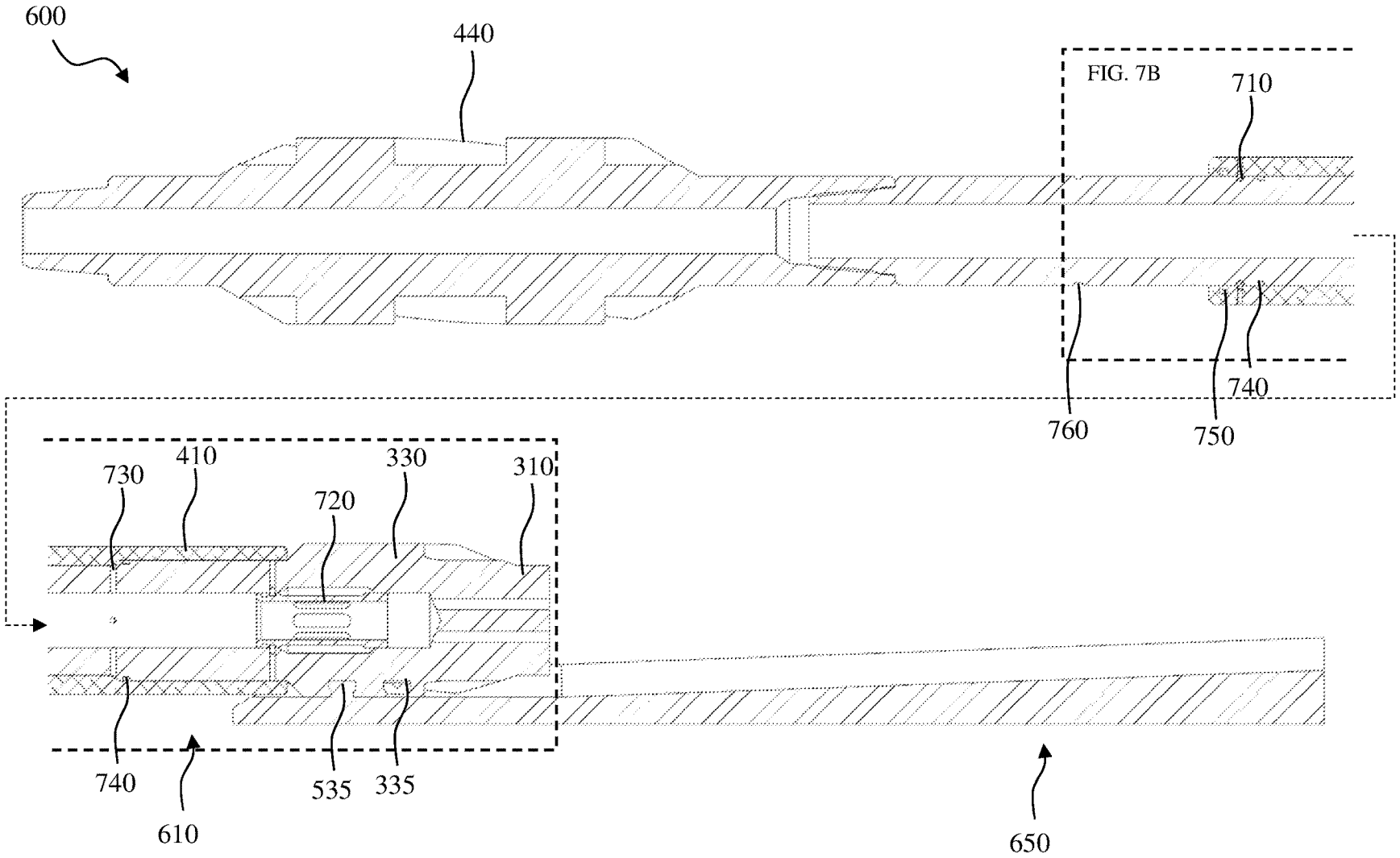
Figure 7B:
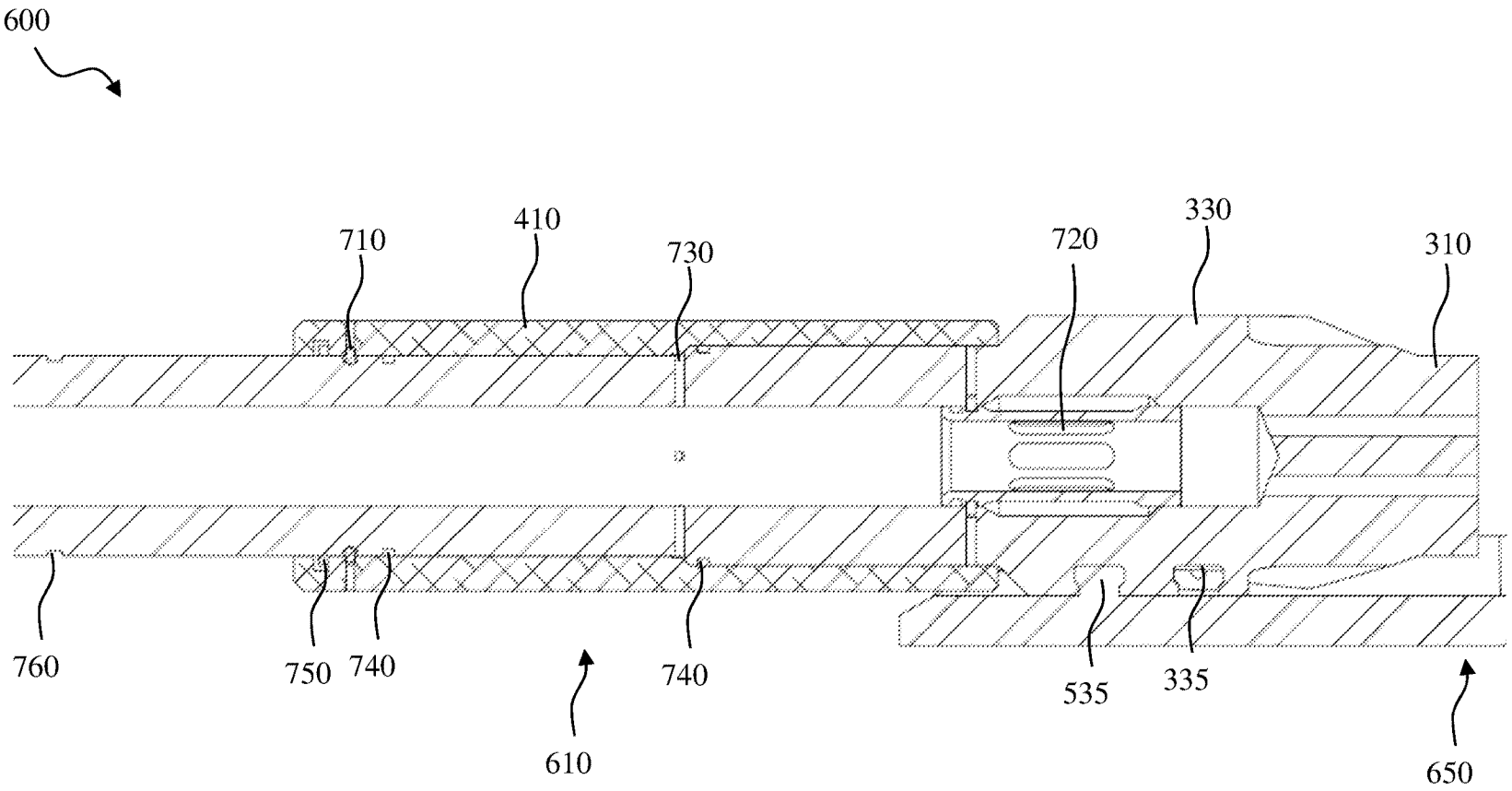

Turning to FIGS. 7A and 7B, illustrated are a cross-sectional view and enlarged cross-sectional view, respectively, of the downhole tool 600 of FIG. 6. FIGS. 7A and 7B also illustrate the downhole tool 600 as it might appear during it's run-in-hole configuration. Accordingly, the lug slot(s) 335 of the milling tool 610 are engaged with the lug(s) 535 of the whipstock assembly 650, and the sliding sleeve 410 is fixed to the mill body 310 using one or more shear features 710.

Figure 9A:
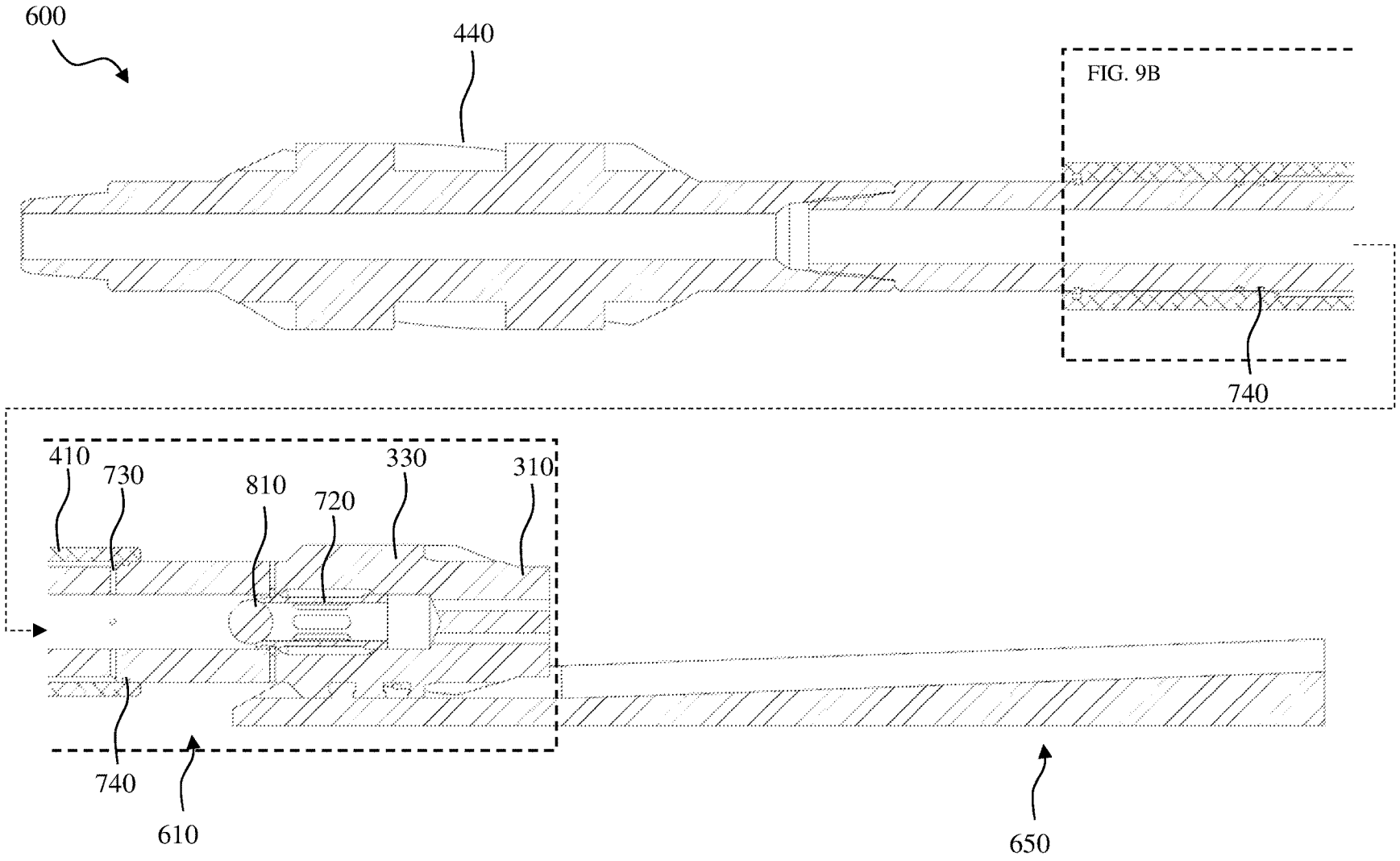
Figure 9B:
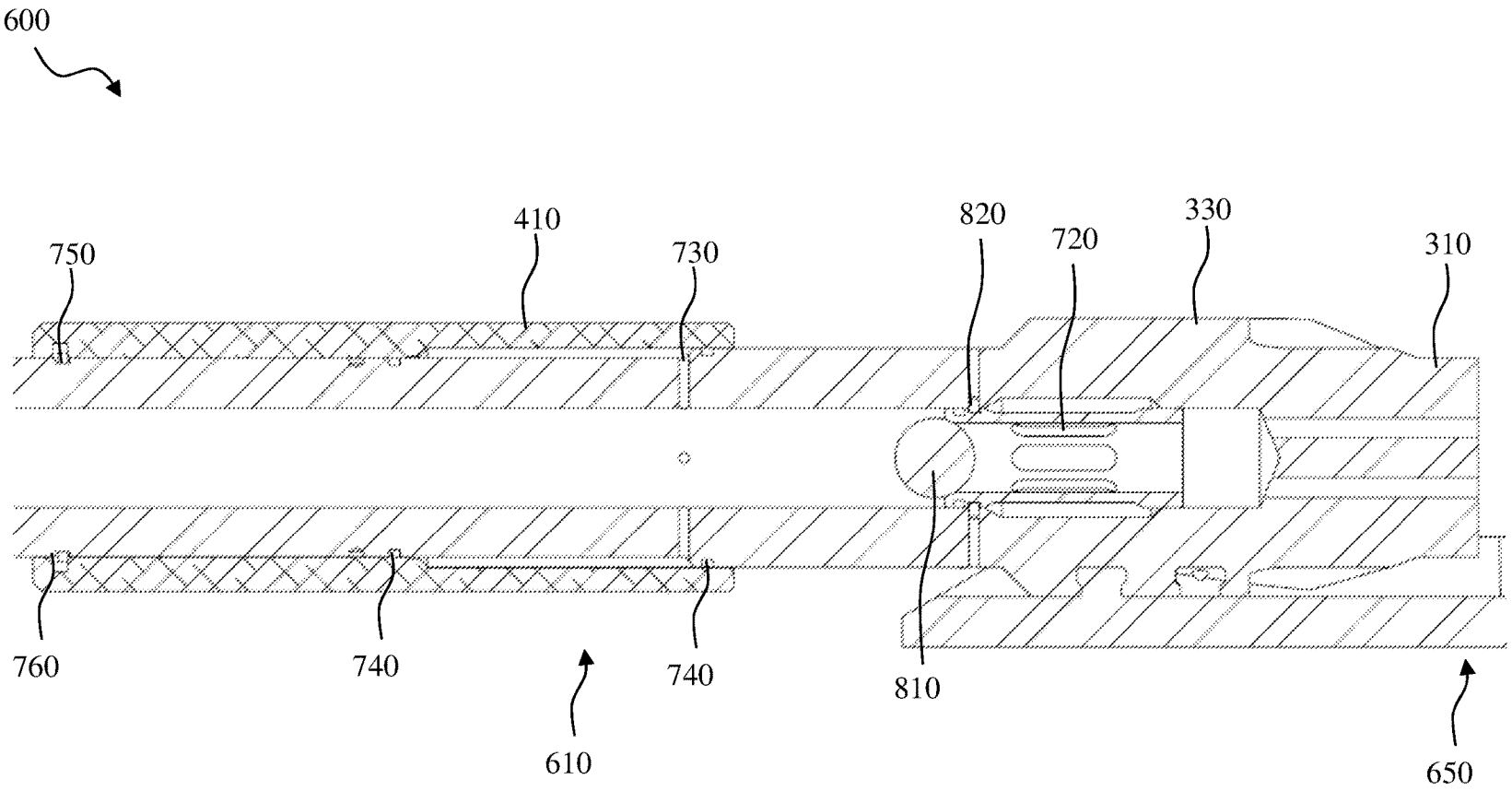

Further to the embodiment of FIGS. 7A and 7B, the milling tool 610 may additionally include a ball seat 720 located along an interior surface thereof. As will be discussed further below, the ball seat 720 is configured to engage with a plugging member (e.g., ball member) to close a fluid passageway through the milling tool 610. The milling tool 610 of FIGS. 7A and 7B may additionally include one or more sliding sleeve pressure ports 730 and related seals 740 associated with the sliding sleeve 410, for example to employ pressure to shift the sliding sleeve 410 from a first position (e.g., as shown in FIGS. 7A and 7B) to a second position (e.g., as shown in FIGS. 9A through 9C).

The milling tool 710 of FIGS. 7A and 7B may additionally include a snap ring 750, for example positioned in the sliding sleeve 410. The snap ring 750, in one or more embodiments, is configured to engage with a snap ring groove 760 in the mill body 310. For example, the snap ring 750 and snap ring groove 760 may engage one another once the sliding sleeve 410 moves to the second position, thus fixing the sliding sleeve 410 in the second position during subsequent downhole operations.

Figure 7C:
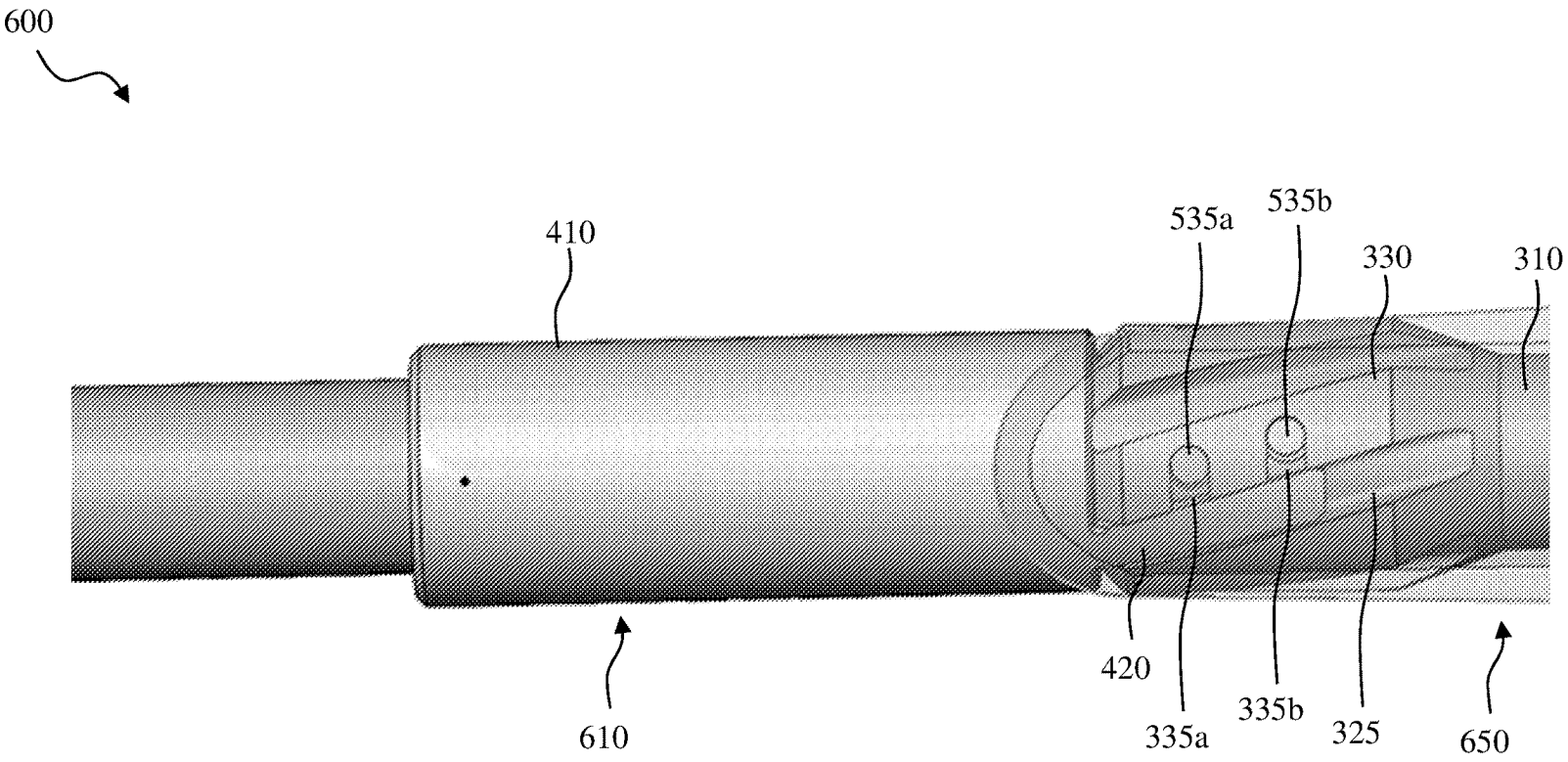

Turning briefly to FIG. 7C, illustrated is a partial transparent bottom view of the downhole tool 600 of FIG. 7B. FIG. 7C illustrates that when the sliding sleeve 410 is in the first position, the finger portion 420 of the sliding sleeve 410 is engaged within the spacing 325. Accordingly, without removing the finger portion 420 from the spacing 325, the lug 535 of the whipstock assembly 650 cannot disengage from the lug slot 335 of the milling tool 610, or vice versa.

Figure 8A:
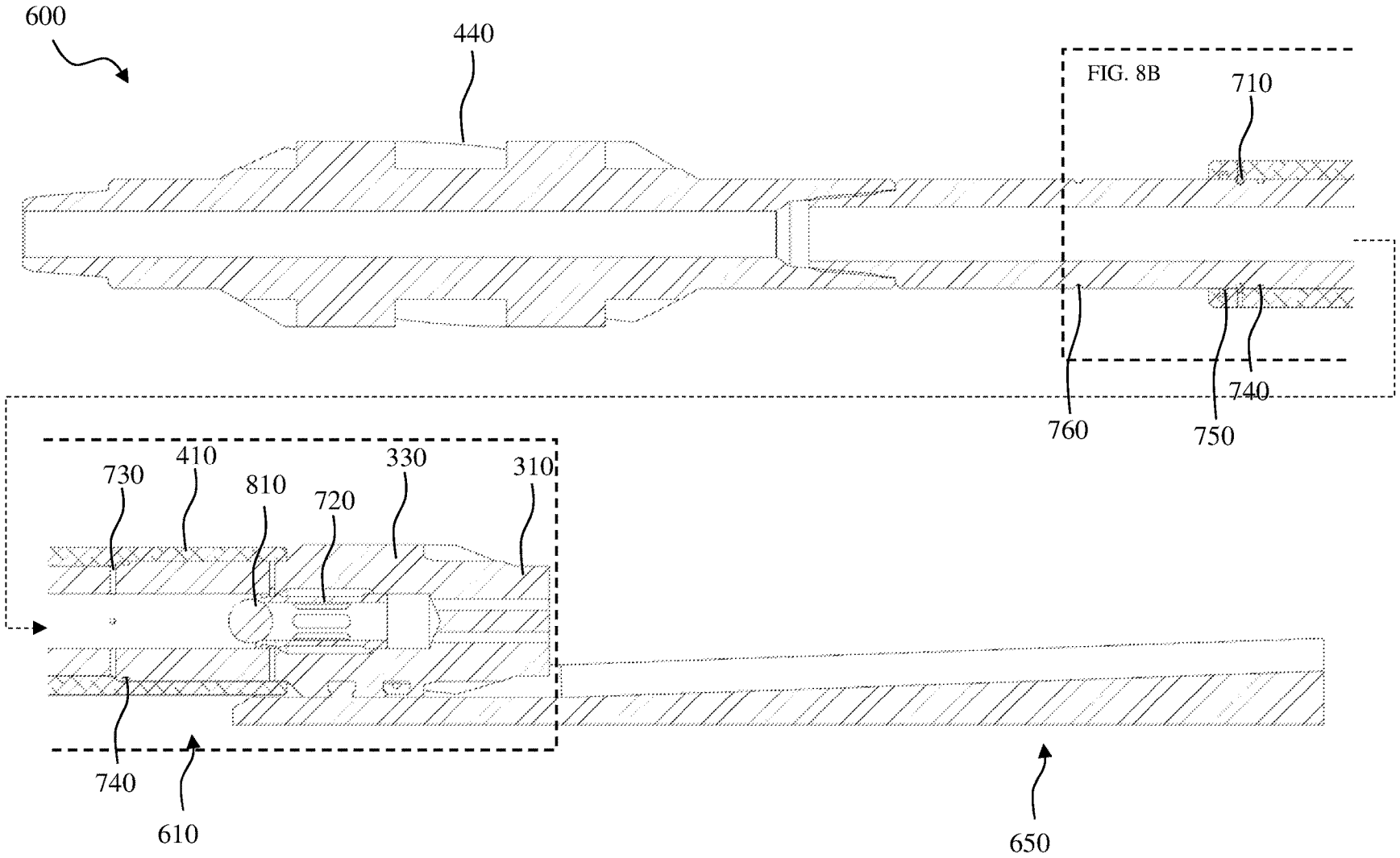
Figure 8B:
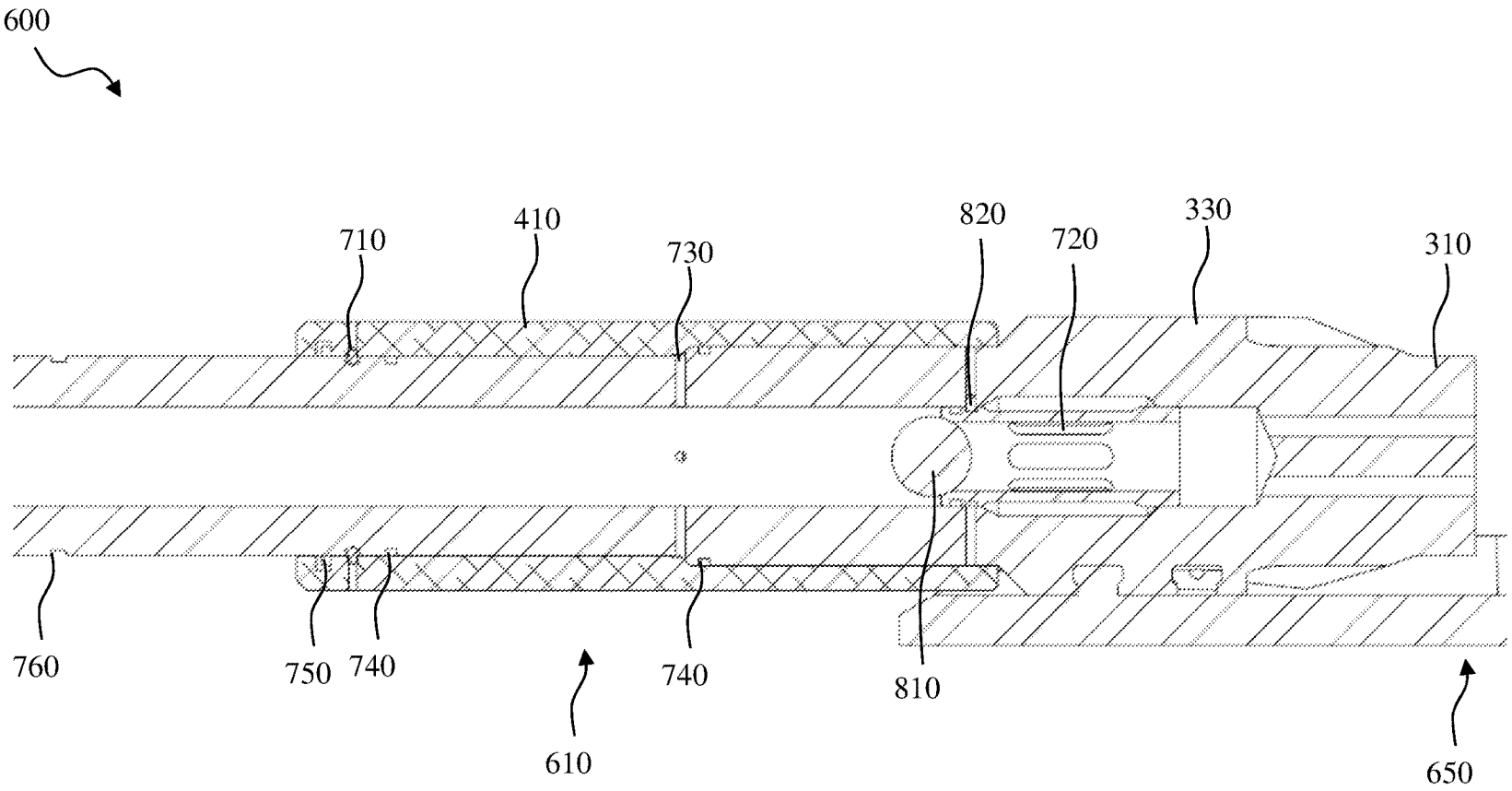

Turning to FIGS. 8A and 8B, illustrated are a cross-sectional view and enlarged cross-sectional view, respectively, of the downhole tool 600 of FIGS. 7A and 7B after dropping a plugging member 810 (e.g., drop ball) within the downhole tool 600. In the illustrated embodiment, the plugging member 810 seats upon the ball seat 720, and thus substantially restricts fluid flow through the downhole tool 600. In one or mor embodiments, a shear feature 820 exists between the mill body 310 and the ball seat 720, such that the ball seal 720 will only shift downhole after a prescribed amount of pressure (e.g., a pressure sufficient to shift the sliding sleeve 410 from its first position to its second position prior to shearing).

Turning to FIGS. 9A and 9B, illustrated are a cross-sectional view and enlarged cross-sectional view, respectively, of the downhole tool 600 of FIGS. 8A and 8B after pressuring down upon the plugging member 810. In the illustrated embodiment, fluid pressure within the mill body 310 exits the one or more sliding sleeve pressure ports 730, thereby employing the seals 740 to shift the sliding sleeve 410 from the first position (e.g., as shown in FIGS. 6 through 7B) to the illustrated second position. As shown, the snap ring 750 may now engage with the snap ring groove 760, thereby holding the sliding sleeve 410 in the second position. While not shown in the illustrated views, the finger portion 420 is no longer located in the spacing 325. Nevertheless, the lug slot(s) 335 and lug(s) 535 remain engaged with one another.

Figure 10A:
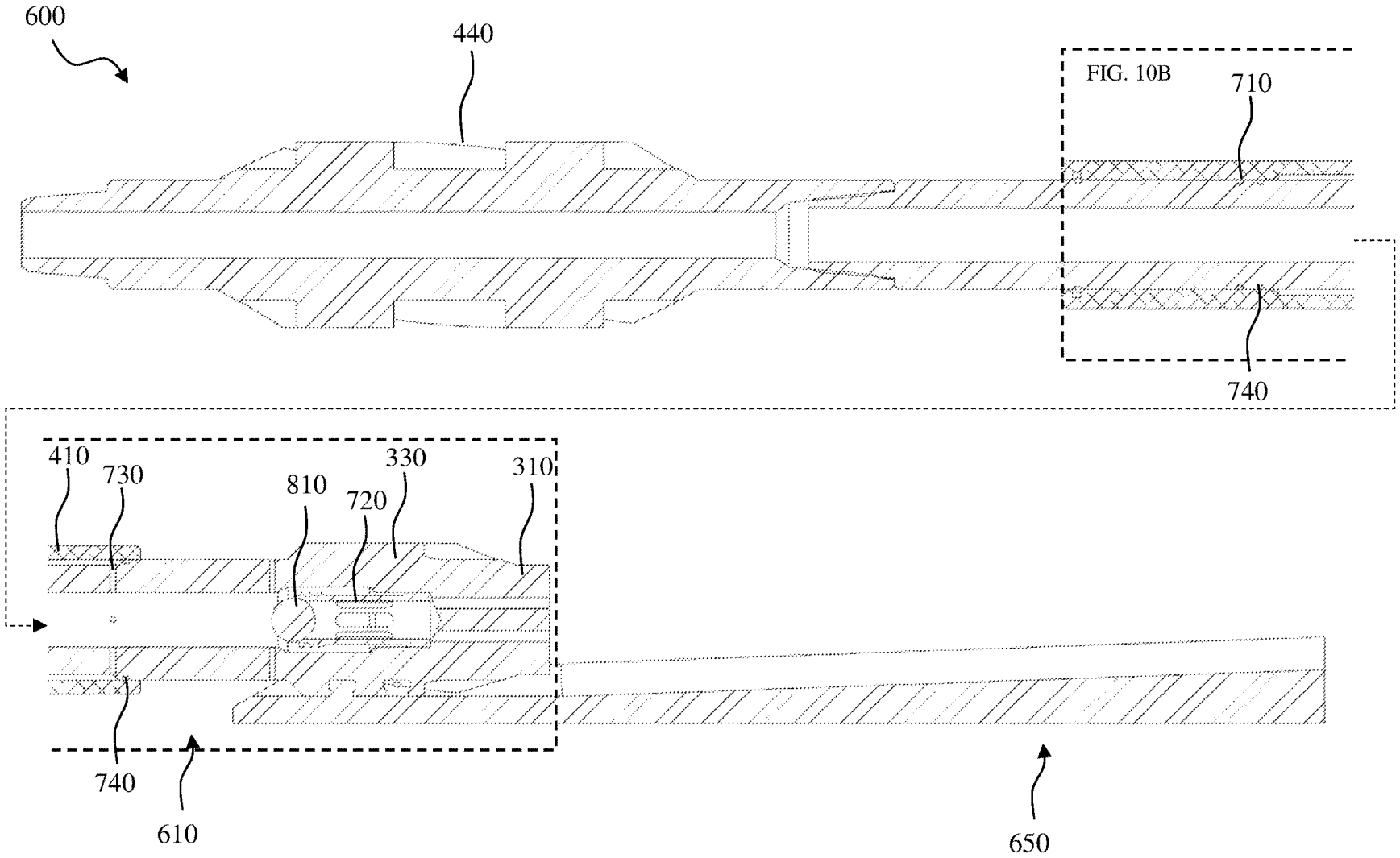
Figure 10B:
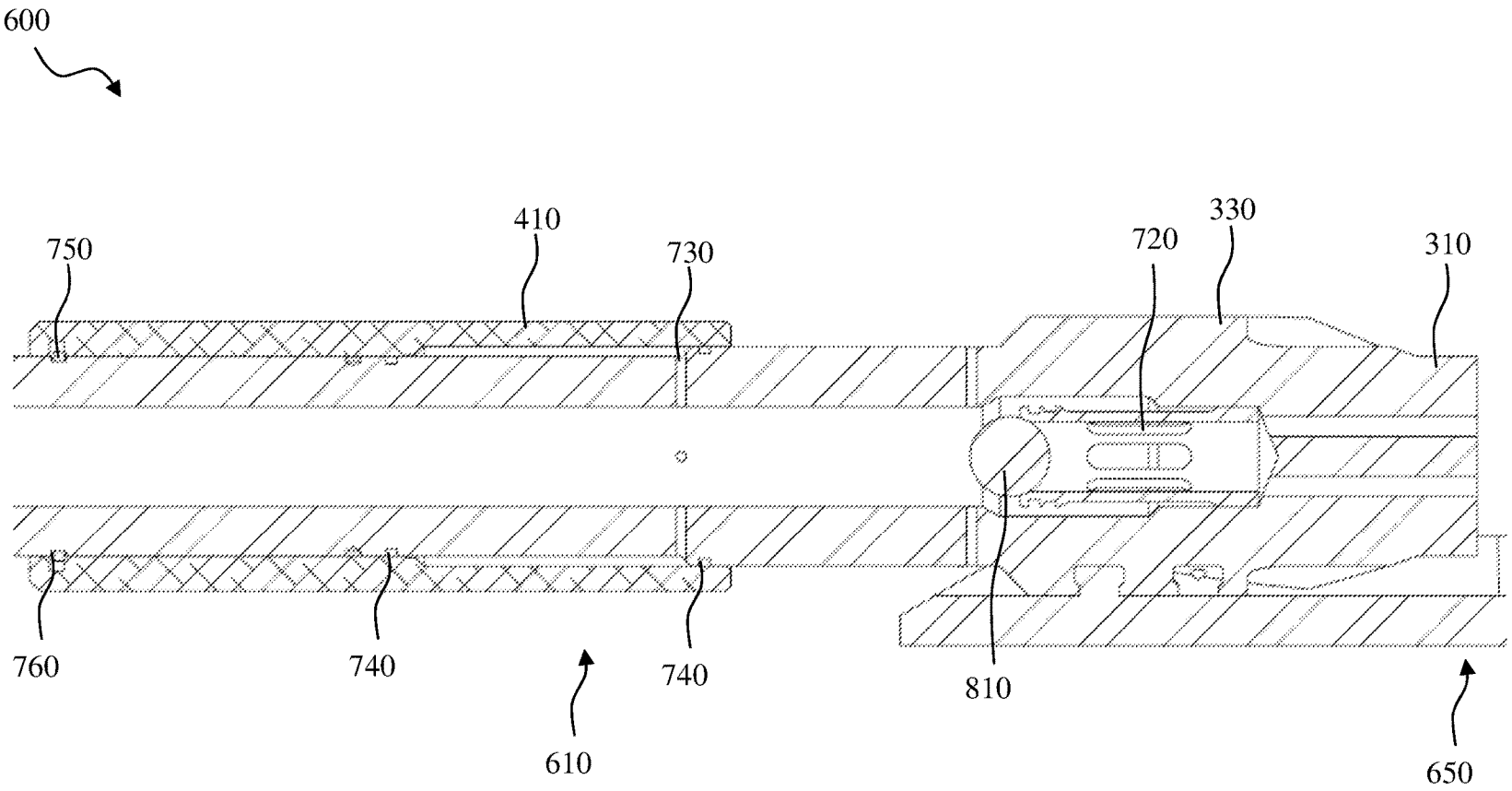

Turning to FIGS. 10A and 10B, illustrated are a cross-sectional view and enlarged cross-sectional view, respectively, of the downhole tool 600 of FIGS. 9A and 9B after continuing to pressuring down upon the plugging member 810, thereby shifting the ball seat 720 further downhole to re-stablish fluid circulation around the plugging member 810 and through the downhole tool 600. Again, the shear feature 820 holds the ball seat 720 in the first position, and the fluid pressure must overcome the shear value of this shear feature 820 for the ball seat 720 to slide to the second position. Nevertheless, in at least one embodiment the lug slot(s) 335 and lug(s) 535 still remain engaged with one another.

Figure 11A:
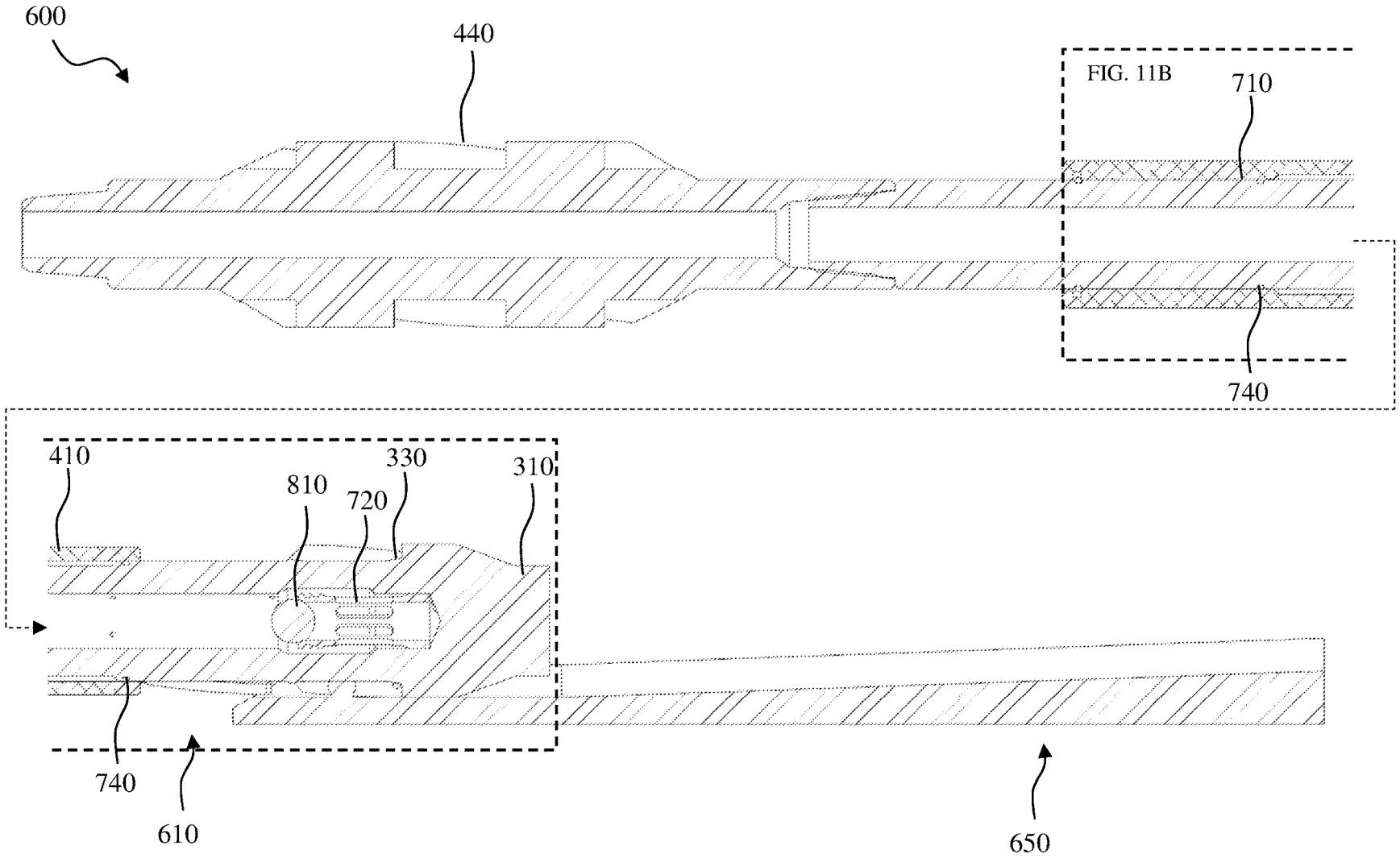
Figure 11B:
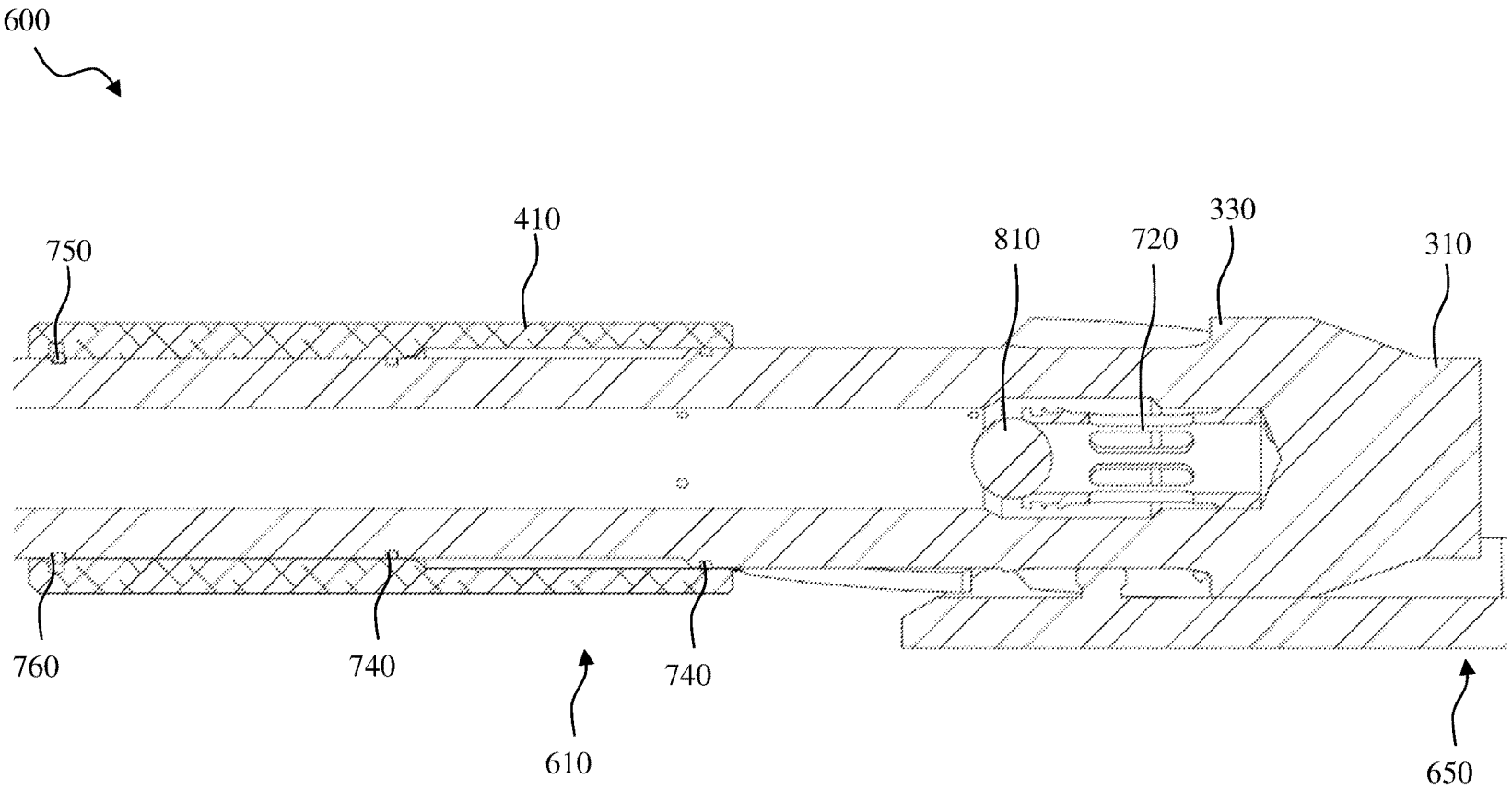

Turning to FIGS. 11A and 11B, illustrated are a cross-sectional view and enlarged cross-sectional view, respectively, of the downhole tool 600 of FIGS. 10A and 10B after rotating the milling tool 610 relative to the whipstock assembly 650 to free the lug(s) 535 from the lug slot(s) 335. Typically, the whipstock assembly 650 is rotationally fixed within the wellbore and the milling tool 610 is rotated to free the lug(s) 535. In at least one embodiment, the milling tool 610 is also being withdrawn uphole as it is being rotated.

Figure 11C:
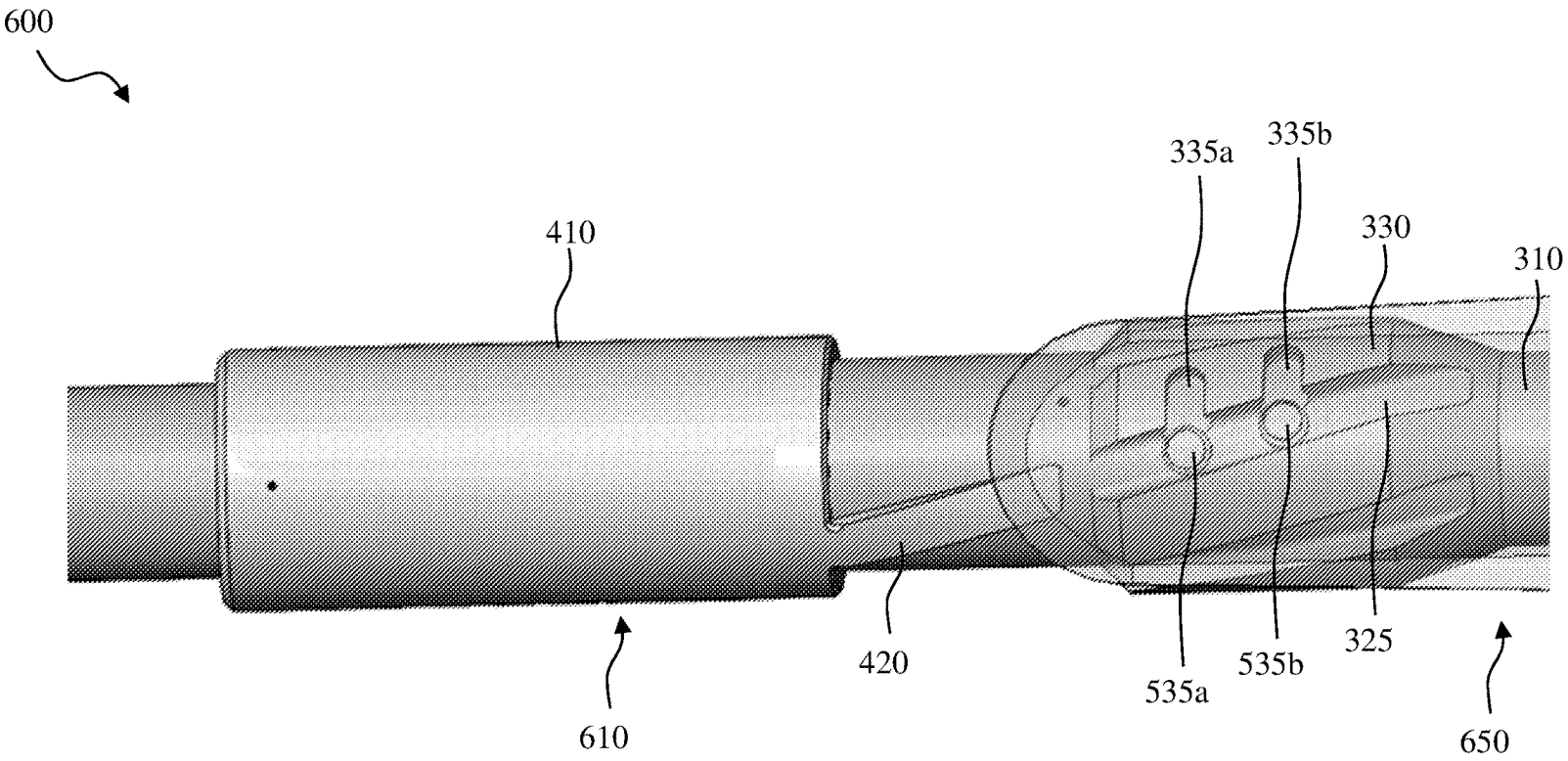

Turning briefly to FIG. 11C, illustrated is a partial transparent bottom view of the downhole tool 600 of FIG. 11B. FIG. 11C illustrates that the sliding of the sliding sleeve 410 from the first position to the second position removes the finger portion 420 of the sliding sleeve 410 from the spacing 325. Accordingly, the lug(s) 535 of the whipstock assembly 650 are no longer prevented from disengaging from the lug slot(s) 335 of the milling tool 610 by the finger portion 420, or vice versa. In fact, in the embodiment of FIG. 11C, the lug slot(s) 335 and the lug(s) 535 have rotated relative to one another, and thus the lug(s) 535 are no longer located within the lug slot(s) 335.

Figure 12:
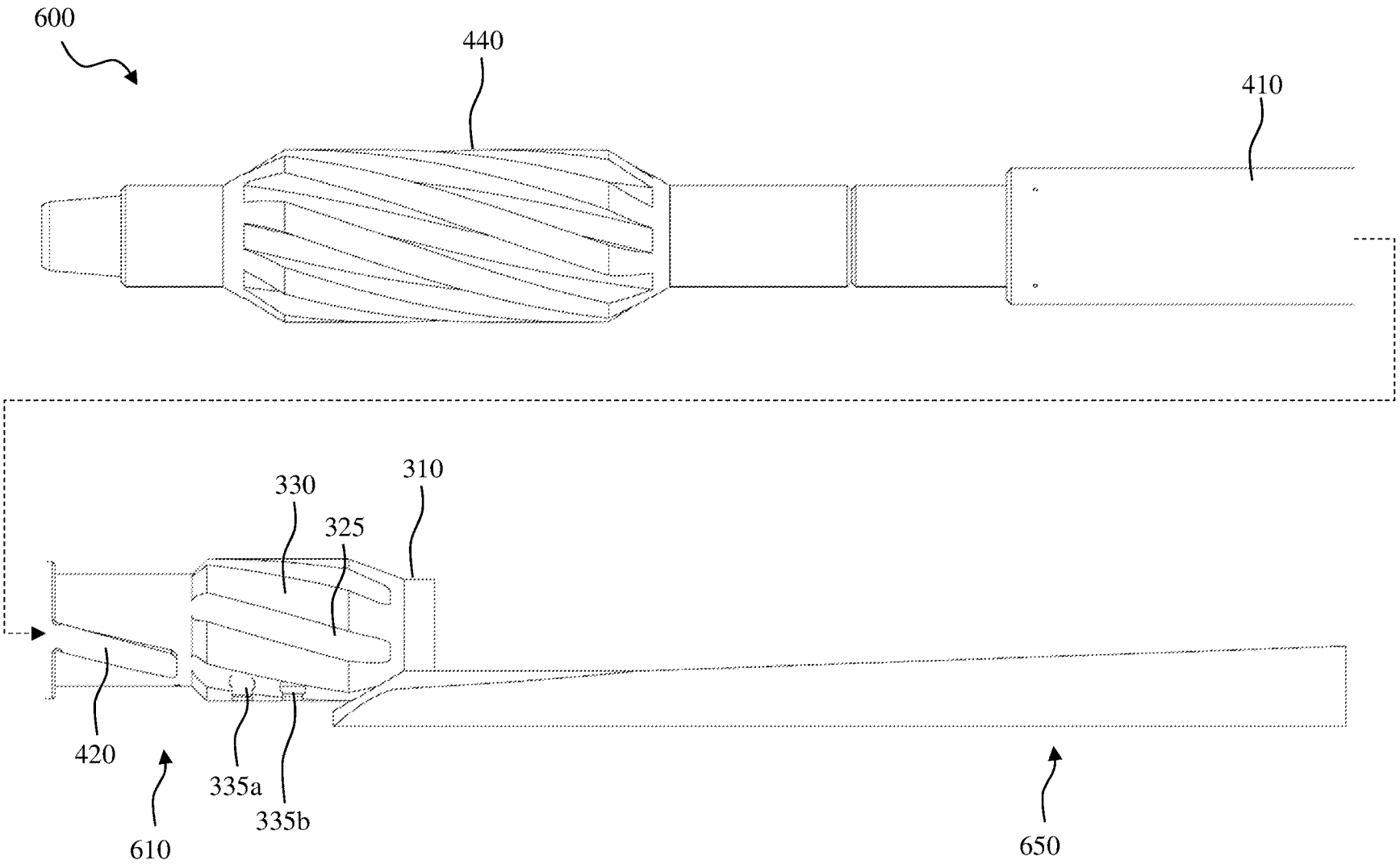

Turning to FIG. 12, illustrated is a side view of the downhole tool 600 of FIGS. 11A and 11B after the milling tool 610 has fully disengaged from the whipstock assembly 650. For example, FIG. 12 illustrates the downhole tool 600 as it might appear just prior to it being used to create an opening in wellbore casing and/or a sidetrack in surrounding formation.

Figure 13A:
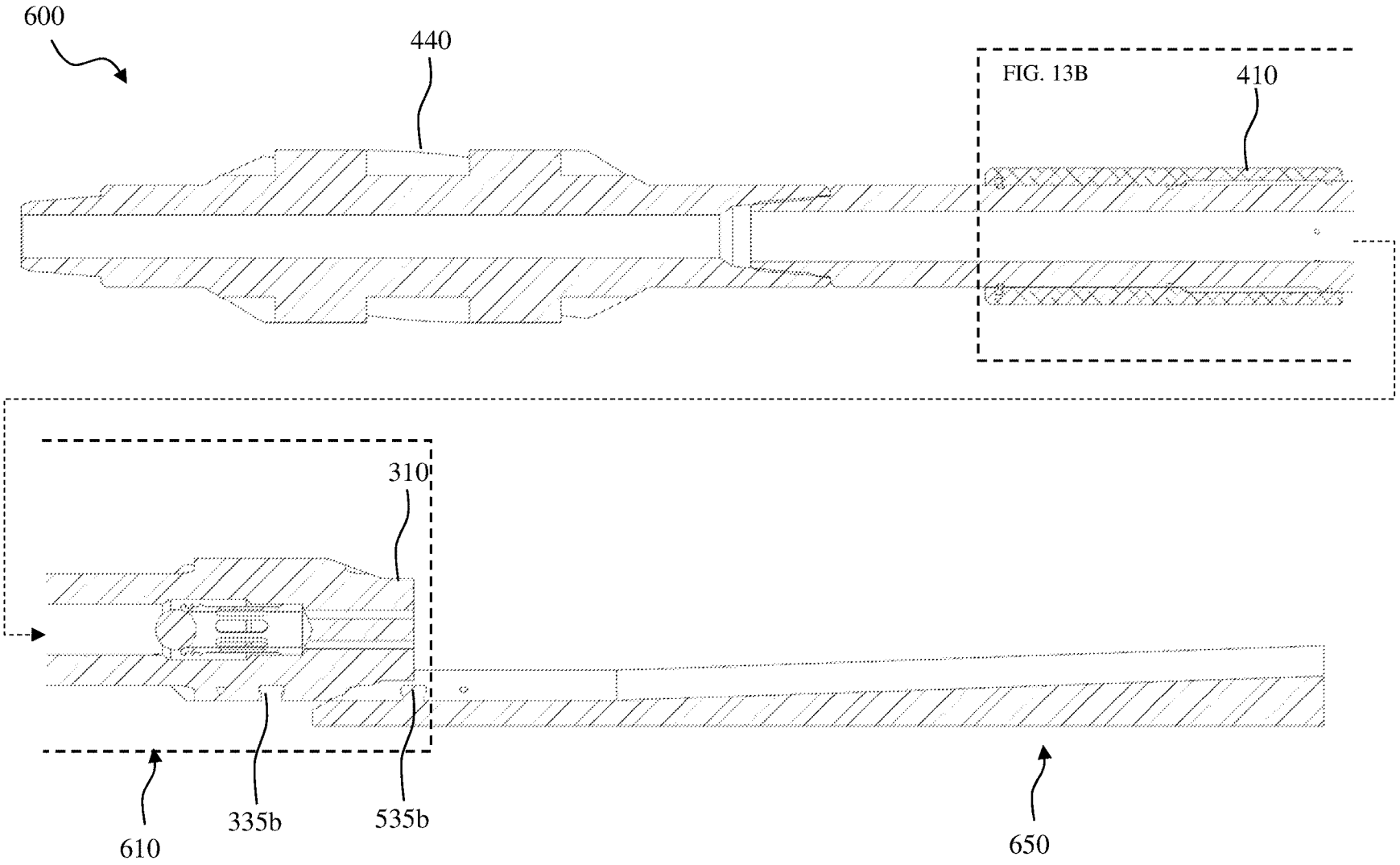
Figure 13B:
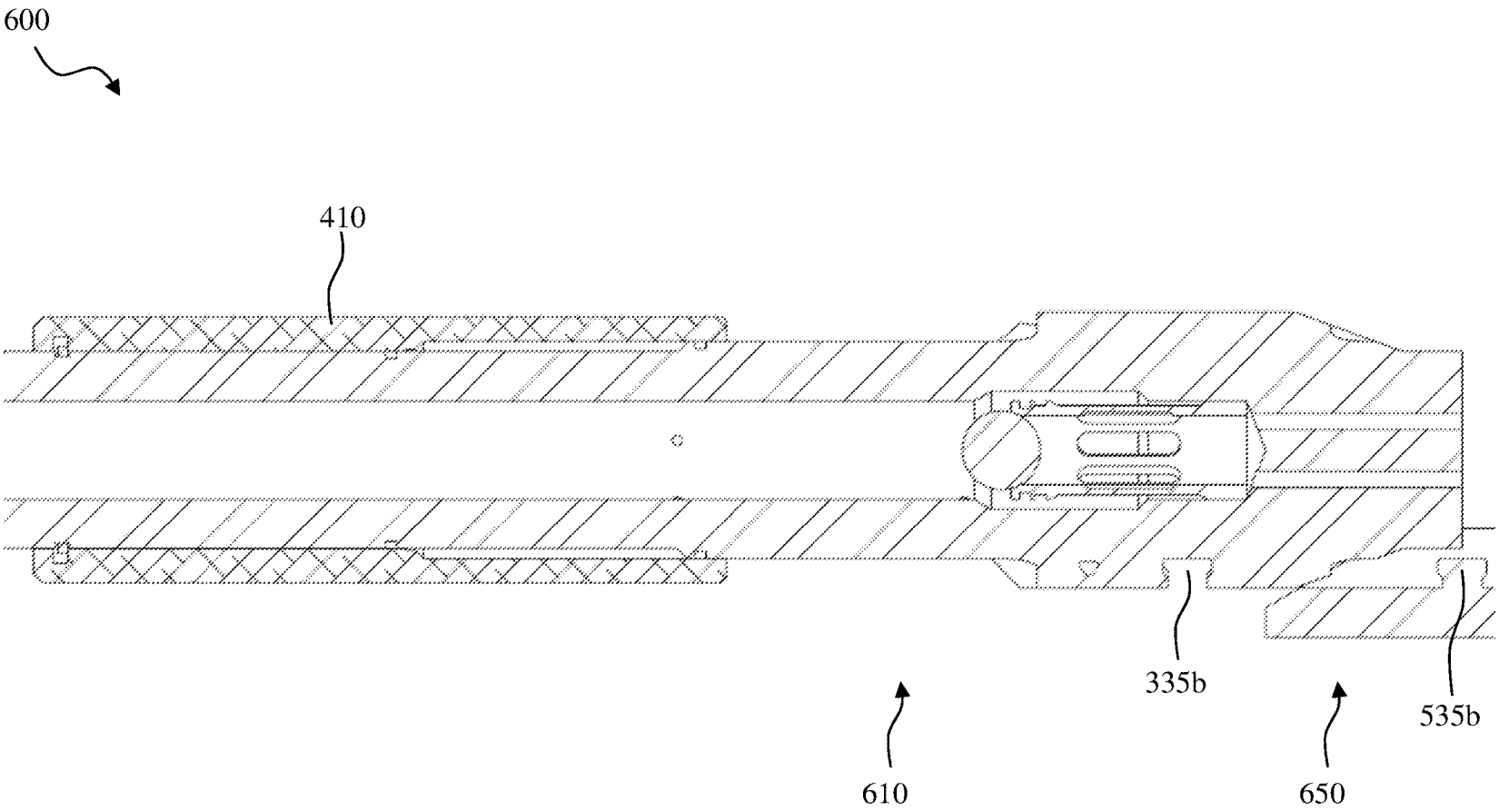

Turning to FIGS. 13A and 13B, illustrated are a cross-sectional view and enlarged cross-sectional view, respectively, of the downhole tool 600 of FIG. 12.

Figure 13C:
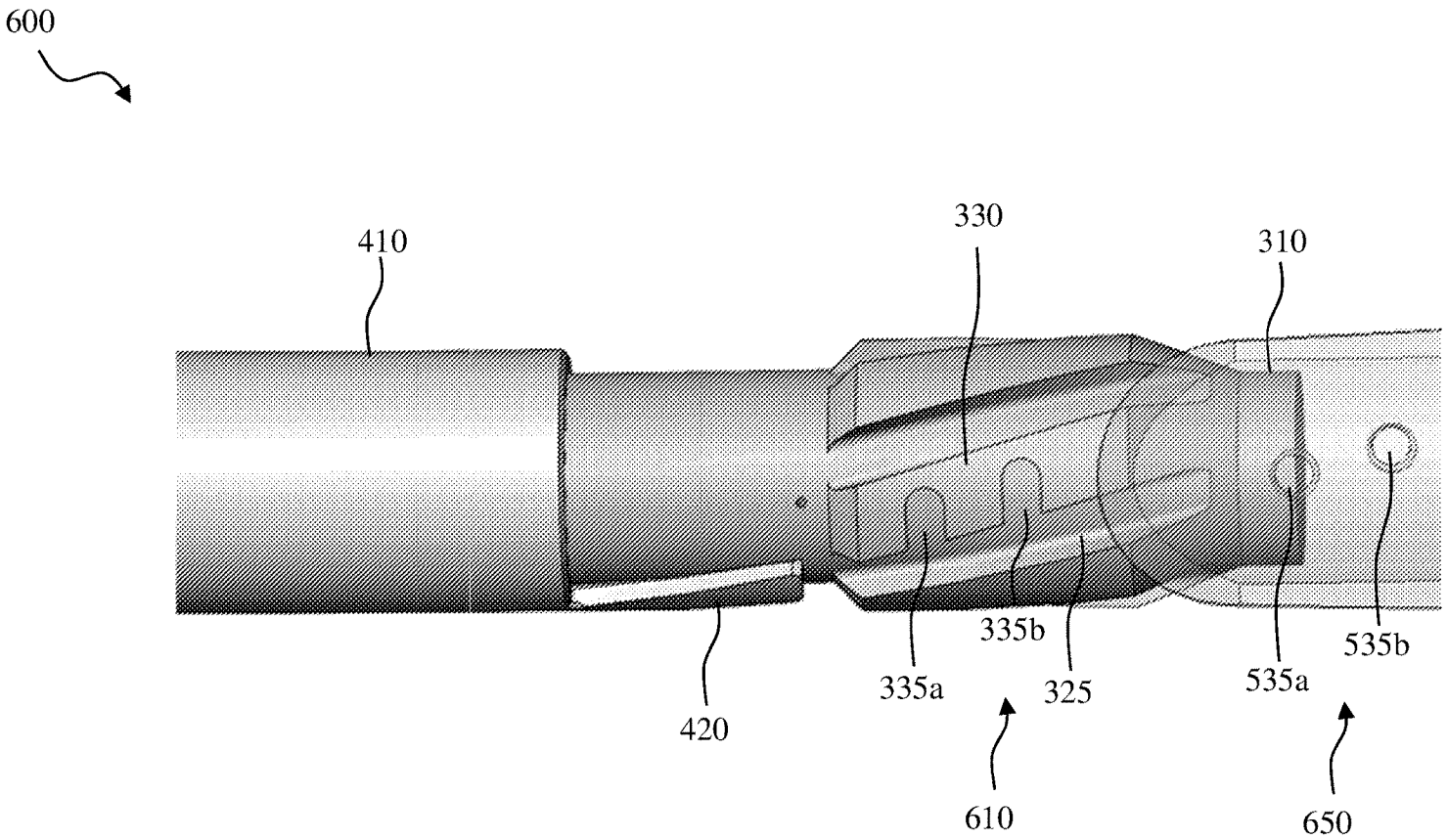

Turning briefly to FIG. 13C, illustrated is a partial transparent bottom view of the downhole tool 600 of FIG. 13B. FIG. 13C illustrates that the lug(s) 535 are no longer engaged with the lug slot(s) 335 or the spacing 325 between the blades 330.

In one or more embodiments, the process would continue by initiating the milling operation. In one or more embodiments, the milling tool 610 would consume the lug(s) 535 and being to mill a window in the casing and/or a sidetrack in the formation. In at least one embodiment, and outside diameter (OD) of the shifting sleeve 410 is less than the cutting diameter (di) of the larger bit assembly, so it can follow in the path created by the larger bit assembly. Also, the shifting sleeve 410 could be made from a material (e.g., aluminum) that could wear away from rubbing against whipstock/casing/formation.

Aspects disclosed herein include:

A. A milling tool, the milling tool including: 1) a mill body; 2) a plurality of blades extending radially outward from the mill body, each of the plurality of blades having a primary surface and first and second side surfaces coupled to opposing sides of the primary surface, adjacent blades of the plurality of blades separated by a spacing; and 3) a lug slot extending partially into one of the plurality of blades from the first side surface exposed by the spacing, the lug slot configured to engage with a lug of a related tool to couple the milling tool with the related tool when rotating in a first direction and to disengage from the lug of the related tool to release the milling tool from the related tool when rotating in a second opposite direction.

B. A whipstock assembly, the whipstock assembly including: 1) a whipstock body having an uphole end and a downhole end, the whipstock body defining a taperface; and 2) a lug coupled proximate the uphole end of the whipstock body, the lug configured to engage with a lug slot of a related milling tool to couple the whipstock assembly with the related milling tool when the milling tool rotates in a first direction and to disengage from the lug slot of the related milling tool to release the whipstock assembly from the related milling tool when the milling tool rotates in a second opposite direction.

C. A well system, the well system including: 1) a wellbore located through one or more subterranean formations; and 2) a downhole tool located within the wellbore, the downhole tool including: a) a whipstock assembly, the whipstock assembly including: i) a whipstock body having an uphole end and a downhole end, the whipstock body defining a taperface; and ii) a lug coupled proximate the uphole end of the whipstock body; and b) a milling tool, the milling tool including: i) a mill body; ii) a plurality of blades extending radially outward from the mill body, each of the plurality of blades having a primary surface and first and second side surfaces coupled to opposing sides of the primary surface, adjacent blades of the plurality of blades separated by a spacing; and iii) a lug slot extending partially into one of the plurality of blades from the first side surface exposed by the spacing, wherein the lug slot is configured to engage with the lug of the whipstock assembly to couple the milling tool with the whipstock assembly when rotating in a first direction and to disengage from the lug of the whipstock assembly to release the milling tool from the whipstock assembly when rotating in a second opposite direction.

D. A method, the method including: 1) running a downhole within a wellbore, the downhole tool including: a) a whipstock assembly, the whipstock assembly including: i) a whipstock body having an uphole end and a downhole end, the whipstock body defining a taperface; and ii) a lug coupled proximate the uphole end of the whipstock body; and b) a milling tool coupled to the whipstock assembly, the milling tool including: i) a mill body; ii) a plurality of blades extending radially outward from the mill body, each of the plurality of blades having a primary surface and first and second side surfaces coupled to opposing sides of the primary surface, adjacent blades of the plurality of blades separated by a spacing; and iii) a lug slot extending partially into one of the plurality of blades from the first side surface exposed by the spacing, wherein the lug slot is configured to engage with the lug of the whipstock assembly to couple the milling tool with the whipstock assembly when rotating in a first direction and to disengage from the lug of the whipstock assembly to release the milling tool from the whipstock assembly when rotating in a second opposite direction; and 2) rotating the downhole tool in the second direction to disengage the milling tool from the whipstock assembly.

Aspects A, B, C and D may have one or more of the following additional elements in combination: Element 1: wherein the lug slot has a larger lug slot portion radially proximate the mill body and a smaller lug slot portion radially distal the mill body. Element 2: wherein the lug slot is an inverted T-shaped lug slot. Element 3: wherein the lug slot is a first lug slot, and further including a second lug slot extending partially into one of the plurality of blades from the first side surface exposed by the spacing. Element 4: wherein the first lug slot and the second lug slot are located in a same one of the plurality of blades. Element 5: wherein the first lug slot is located in a first of the plurality of blades and the second lug slot is located in a second of the plurality of blades. Element 6: further including a sliding sleeve having a finger portion, the sliding sleeve positioned about the mill body proximate the plurality of blades, the sliding sleeve configured to move between a first position locating the finger portion within the spacing proximate the lug slot and a second position removing the finger portion from the spacing proximate the lug slot, the first position configured to keep the lug of the related tool engaged within the lug slot and the second position configured to allow the lug of the related tool to disengage from the lug slot. Element 7: wherein the plurality of blades are angled relative to an axis of rotation of the mill body, and further wherein the finger portion is angled relative to the axis of rotation of the mill body. Element 8: wherein a first angle of the plurality of blades is substantially identical to a second angle of the finger portion. Element 9: wherein the sliding sleeve is a hydraulically activated sliding sleeve, an increase in pressure within the mill body configured to move the sliding sleeve from the first position to the second position. Element 10: wherein the lug has a smaller lug portion and a larger lug portion, the smaller lug portion more proximate the whipstock body than the larger lug portion. Element 11: wherein the lug is a T-shaped lug, the smaller lug portion coupled to the whipstock body. Element 12: wherein the lug is a first lug, and further including a second lug coupled proximate the uphole end of the whipstock body. Element 13: wherein a centerline taken through the first lug and the second lug is angled relative to a longitudinal centerline of the whipstock body. Element 14: wherein an angle ($\theta_3$) between the centerline taken through the first lug and the second lug and the longitudinal centerline is substantially identical to an angle ($\theta_1$) of a plurality of blades of the related milling tool that the whipstock assembly is configured to engage. Element 15: wherein the lug is integrally formed with the whipstock body. Element 16: wherein the lug is coupled to the whipstock body via an opening in the whipstock body. Element 17: wherein a fastener extends at least partially into the opening to couple the lug to the whipstock body. Element 18: wherein the lug is coupled to a concave portion of the whipstock body. Element 19: wherein the lug slot has a larger lug slot portion radially proximate the mill body and a smaller lug slot portion radially distal the mill body, and the lug has a smaller lug portion and a larger lug portion, the smaller lug portion more proximate the whipstock body than the larger lug portion. Element 20: wherein the lug slot is an inverted T-shaped lug slot and the lug is a T-shaped lug, the smaller lug portion coupled to the whipstock body. Element 21: wherein the lug slot is a first lug slot, and further including a second lug slot extending partially into one of the plurality of blades from the first side surface exposed by the spacing, and further wherein the lug is a first lug, and further including a second lug coupled proximate the uphole end of the whipstock body. Element 22: wherein the first lug slot and the second lug slot are located in a same one of the plurality of blades. Element 23: wherein the milling tool further includes a sliding sleeve having a finger portion, the sliding sleeve positioned about the mill body proximate the plurality of blades. Element 24: wherein the sliding sleeve is configured to move between a first position locating the finger portion within the spacing proximate the lug slot and a second position removing the finger portion from the spacing proximate the lug slot, the first position configured to keep the lug of the whipstock assembly engaged within the lug slot and the second position configured to allow the lug of the whipstock assembly to disengage from the lug slot. Element 25: wherein the lug slot is engaged with the lug, and further wherein the sliding sleeve is in the first position keeping the lug of the whipstock assembly engaged within the lug slot. Element 26: wherein the lug slot is engaged with the lug, and further wherein the sliding sleeve is in the second position allowing the lug of the whipstock assembly to disengage from the lug slot. Element 27: wherein the sliding sleeve is a hydraulically activated sliding sleeve, an increase in pressure within the mill body configured to move the sliding sleeve from the first position to the second position. Element 28: wherein the milling tool further includes a sliding sleeve having a finger portion, the sliding sleeve positioned about the mill body proximate the plurality of blades. Element 29: wherein the sliding sleeve is configured to move between a first position locating the finger portion within the spacing proximate the lug slot and a second position removing the finger portion from the spacing proximate the lug slot, the first position configured to keep the lug of the whipstock assembly engaged within the lug slot and the second position configured to allow the lug of the whipstock assembly to disengage from the lug slot. Element 30: wherein running the downhole tool within the wellbore include running the downhole tool within the wellbore with the sliding sleeve in the first position. Element 31: further including moving the sliding sleeve from the first position to the second position after running the downhole tool within the wellbore and before rotating the downhole tool in the second direction.

Those skilled in the art to which this application relates will appreciate that other and further additions, deletions, substitutions and modifications may be made to the described embodiments.

What is claimed is:

1. A whipstock assembly, comprising:

a whipstock body having an uphole end and a downhole end, the whipstock body defining a taperface; and a lug coupled proximate the uphole end of the whipstock body, the lug configured to engage with a lug slot of a related milling tool to couple the whipstock assembly with the related milling tool when the milling tool rotates in a first direction and to disengage from the lug slot of the related milling tool to release the whipstock assembly from the related milling tool when the milling tool rotates in a second opposite direction, wherein the lug is a first lug, and further including a second lug coupled proximate the uphole end of the whipstock body.

2. The whipstock assembly as recited in claim 1, wherein the lug has a smaller lug portion and a larger lug portion, the smaller lug portion more proximate the whipstock body than the larger lug portion.

3. The whipstock assembly as recited in claim 2, wherein the lug is a T-shaped lug, the smaller lug portion coupled to the whipstock body.

4. The whipstock assembly as recited in claim 1, wherein a centerline taken through the first lug and the second lug is angled relative to a longitudinal centerline of the whipstock body.

5. The whipstock assembly as recited in claim 4, wherein an angle ($\theta_3$) between the centerline taken through the first lug and the second lug and the longitudinal centerline is substantially identical to an angle ($\theta_1$) of a plurality of blades of the related milling tool that the whipstock assembly is configured to engage.

6. The whipstock assembly as recited in claim 1, wherein the lug is integrally formed with the whipstock body.

7. The whipstock assembly as recited in claim 1, wherein the lug is coupled to the whipstock body via an opening in the whipstock body.

8. The whipstock assembly as recited in claim 7, wherein a fastener extends at least partially into the opening to couple the lug to the whipstock body.

9. The whipstock assembly as recited in claim 1, wherein the lug is coupled to a concave portion of the whipstock body.

10. A well system, comprising:

a wellbore located through one or more subterranean formations; and a downhole tool located within the wellbore, the downhole tool including:

a whipstock assembly, the whipstock assembly including:

a whipstock body having an uphole end and a downhole end, the whipstock body defining a taperface; and a lug coupled proximate the uphole end of the whipstock body; and a milling tool, the milling tool including:

a mill body;

a plurality of blades extending radially outward from the mill body, each of the plurality of blades having a primary surface and first and second side surfaces coupled to opposing sides of the primary surface, adjacent blades of the plurality of blades separated by a spacing; and a lug slot extending partially into one of the plurality of blades from the first side surface exposed by the spacing, wherein the lug slot is configured to engage with the lug of the whipstock assembly to couple the milling tool with the whipstock assembly when rotating in a first direction and to disengage from the lug of the whipstock assembly to release the milling tool from the whipstock assembly when rotating in a second opposite direction.

11. The well system as recited in claim 10, wherein the lug slot has a larger lug slot portion radially proximate the mill body and a smaller lug slot portion radially distal the mill body, and the lug has a smaller lug portion and a larger lug portion, the smaller lug portion more proximate the whipstock body than the larger lug portion.

12. The well system as recited in claim 11, wherein the lug slot is an inverted T-shaped lug slot and the lug is a T-shaped lug, the smaller lug portion coupled to the whipstock body.

13. The well system as recited in claim 10, wherein the lug slot is a first lug slot, and further including a second lug slot extending partially into one of the plurality of blades from the first side surface exposed by the spacing, and further wherein the lug is a first lug, and further including a second lug coupled proximate the uphole end of the whipstock body.

14. The well system as recited in claim 13, wherein the first lug slot and the second lug slot are located in a same one of the plurality of blades.

15. The well system as recited in claim 10, wherein the milling tool further includes a sliding sleeve having a finger portion, the sliding sleeve positioned about the mill body proximate the plurality of blades.

16. The well system as recited in claim 15, wherein the sliding sleeve is configured to move between a first position locating the finger portion within the spacing proximate the lug slot and a second position removing the finger portion from the spacing proximate the lug slot, the first position configured to keep the lug of the whipstock assembly engaged within the lug slot and the second position configured to allow the lug of the whipstock assembly to disengage from the lug slot.

17. The well system as recited in claim 16, wherein the lug slot is engaged with the lug, and further wherein the sliding sleeve is in the first position keeping the lug of the whipstock assembly engaged within the lug slot.

18. The well system as recited in claim 16, wherein the lug slot is engaged with the lug, and further wherein the sliding sleeve is in the second position allowing the lug of the whipstock assembly to disengage from the lug slot.

19. The well system as recited in claim 16, wherein the sliding sleeve is a hydraulically activated sliding sleeve, an increase in pressure within the mill body configured to move the sliding sleeve from the first position to the second position.

20. A method, comprising:

running a downhole within a wellbore, the downhole tool including:

a whipstock assembly, the whipstock assembly including:

a whipstock body having an uphole end and a downhole end, the whipstock body defining a taperface; and a lug coupled proximate the uphole end of the whipstock body; and a milling tool coupled to the whipstock assembly, the milling tool including:

a mill body;

a plurality of blades extending radially outward from the mill body, each of the plurality of blades having a primary surface and first and second side surfaces coupled to opposing sides of the primary surface, adjacent blades of the plurality of blades separated by a spacing; and a lug slot extending partially into one of the plurality of blades from the first side surface exposed by the spacing, wherein the lug slot is configured to engage with the lug of the whipstock assembly to couple the milling tool with the whipstock assembly when rotating in a first direction and to disengage from the lug of the whipstock assembly to release the milling tool from the whipstock assembly when rotating in a second opposite direction; and rotating the downhole tool in the second direction to disengage the milling tool from the whipstock assembly.

21. The method as recited in claim 20, wherein the milling tool further includes a sliding sleeve having a finger portion, the sliding sleeve positioned about the mill body proximate the plurality of blades.

22. The method as recited in claim 21, wherein the sliding sleeve is configured to move between a first position locating the finger portion within the spacing proximate the lug slot and a second position removing the finger portion from the spacing proximate the lug slot, the first position configured to keep the lug of the whipstock assembly engaged within the lug slot and the second position configured to allow the lug of the whipstock assembly to disengage from the lug slot.

23. The method as recited in claim 22, wherein running the downhole tool within the wellbore include running the downhole tool within the wellbore with the sliding sleeve in the first position.

24. The method as recited in claim 23, further including moving the sliding sleeve from the first position to the second position after running the downhole tool within the wellbore and before rotating the downhole tool in the second direction.

25. A whipstock assembly, comprising:

a whipstock body having an uphole end and a downhole end, the whipstock body defining a taperface; and a lug coupled proximate the uphole end of the whipstock body, the lug configured to engage with a lug slot of a related milling tool to couple the whipstock assembly with the related milling tool when the milling tool rotates in a first direction and to disengage from the lug slot of the related milling tool to release the whipstock assembly from the related milling tool when the milling tool rotates in a second opposite direction, wherein the lug is a T-shaped lug having a smaller lug portion and a larger lug portion, the smaller lug portion coupled to the whipstock body.

* * * * *